US011278998B2

(12) United States Patent
Osaki et al.

(10) Patent No.: US 11,278,998 B2
(45) Date of Patent: Mar. 22, 2022

(54) DOUBLE DISC SURFACE GRINDING MACHINE AND GRINDING METHOD

(71) Applicant: Nissei Industry Corporation, Toyama (JP)

(72) Inventors: Sajio Osaki, Toyama (JP); Masao Annen, Toyama (JP); Tsuyoshi Sano, Toyama (JP)

(73) Assignee: NISSEI INDUSTRY CORPORATION, Toyama (JP)

( * ) Notice: Subject to any disclaimer, the term of this patent is extended or adjusted under 35 U.S.C. 154(b) by 249 days.

(21) Appl. No.: 15/907,569

(22) Filed: Feb. 28, 2018

(65) Prior Publication Data

US 2018/0257193 A1 Sep. 13, 2018

(51) Int. Cl.
*B24B 7/17* (2006.01)
*B24B 37/08* (2012.01)
(Continued)

(52) U.S. Cl.
CPC ..... *B24B 7/17* (2013.01); *B24B 37/042* (2013.01); *B24B 37/08* (2013.01); *B24B 37/28* (2013.01);
(Continued)

(58) Field of Classification Search
CPC ..... B24B 7/17; B24B 37/042; B24B 37/08; B24B 37/28; B24B 37/30; B24B 37/32; B24B 41/06; B24B 41/067
(Continued)

(56) References Cited

U.S. PATENT DOCUMENTS 4,782,631 A 11/1988 Nishio
2011/0053470 A1* 3/2011 Kato ..... B24B 37/28 451/63
(Continued)

FOREIGN PATENT DOCUMENTS

JP S60-42552 U 3/1985
JP H3-14291 Y2 3/1991
(Continued)

OTHER PUBLICATIONS

Office Action pursuant to Article 94(3) EPC of European Patent Application No. 18155756.2 dated Jul. 26, 2019 (5 sheets).
(Continued)

*Primary Examiner* — Eileen P Morgan
(74) *Attorney, Agent, or Firm* — Kratz, Quintos & Hanson, LLP

(57) ABSTRACT

A double disc surface grinding machine includes a clamp band which has a non-circular outer circumferential portion. The clamp band is attached to an outer circumferential surface of a work and is housed, under the attached state, in a storage portion which has a non-circular inner circumferential portion engageable with the outer circumferential portion of the clamp band, movably in a first direction. A rotation drive unit rotates the storage portion around a first rotation shaft extending in the first direction, to make the inner circumferential portion of the storage portion engage with the outer circumferential portion of the clamp band, thereby rotates the clamp band and the work together with the storage portion. At least one of the grinding wheels is fed onto the work so as to sandwich the work with a pair of rotating grinding wheels for grinding two main surfaces of the work.

14 Claims, 13 Drawing Sheets

(51) Int. Cl.

| | |
|---|---|
| ***B24B 37/28*** | (2012.01) |
| ***B24B 37/32*** | (2012.01) |
| ***B24B 41/06*** | (2012.01) |
| ***B24B 41/00*** | (2006.01) |
| ***B24B 37/04*** | (2012.01) |

(52) U.S. Cl.
CPC ..... *B24B 37/32* (2013.01); *B24B 41/005* (2013.01); *B24B 41/06* (2013.01); *B24B 41/067* (2013.01)

(58) Field of Classification Search
USPC ..... 451/41, 285, 287, 398
See application file for complete search history.

(56) References Cited

U.S. PATENT DOCUMENTS

| | | | | |
|---|---|---|---|---|
| 2013/0084783 | A1* | 4/2013 | Jozaki | B24B 37/08 451/28 |
| 2019/0160627 | A1* | 5/2019 | Mikuriya | H01L 21/304 |

FOREIGN PATENT DOCUMENTS

| | | | | |
|---|---|---|---|---|
| JP | H3-40531 | Y2 | 8/1991 | |
| JP | 06-042054 | U | 6/1994 | |
| JP | 6-46854 | U | 6/1994 | |
| JP | 8-323595 | A | 12/1996 | |
| JP | 2003-48156 | A | 2/2003 | |
| JP | 2003-117784 | A | 4/2003 | |
| JP | 2003-124167 | A | 4/2003 | |
| JP | 2004-025384 | A | 1/2004 | |
| JP | 3773821 | B2 | 5/2006 | |
| JP | 2007-098543 | A | 4/2007 | |
| JP | 2014-79821 | A | 5/2014 | |
| KR | 10-2010-0082137 | A | 7/2010 | |
| WO | WO-2010132181 | A2 * | 11/2010 | B24B 37/30 |

OTHER PUBLICATIONS

Office Action of Japanese Patent Application No. 2017-044321: Notification of Reasons for Refusal dated Aug. 9, 2018 (4 pages, 4 pages translation, 8 pages total).
Extended European Search Report for European Application No. 18155756.2 dated Aug. 7, 2018 (10 sheets).

* cited by examiner

DOUBLE DISC SURFACE GRINDING MACHINE AND GRINDING METHOD

BACKGROUND OF THE INVENTION

Field of the Invention

The present invention relates to a double disc surface grinding machine and a grinding method, and more specifically to a double disc surface grinding machine which grinds two main surfaces of a work by rotating a pair of grinding wheels, and a grinding method therefor.

Description of the Related Art

As an example of conventional art of this kind, JP-U S60-42552 discloses a double disc grinding machine which includes an anti-rotation means for rotating a work. JP-U S60-42552 discloses an embodiment in its FIG. 5, where a protrusion provided in a jig which holds a work is fitted into a recess formed in the work, whereby the work is allowed to be rotated together with the jig. Also, JP-U S60-42552 discloses an embodiment in its FIG. 6, where an elastic member is provided in an inner circumferential groove of a jig, so that the elastic member is pressed onto an outer circumferential surface of a work. As the elastic member rotates with the jig, a frictional force is generated at surfaces of contact between the elastic member and the work, whereby the work is rotated together with the jig.

The embodiment disclosed in FIG. 5 in JP-U S60-42552 is not capable of rotating a work which is not formed with the recess together with the jig, resulting in decreased machining accuracy of the work. Also, the embodiment disclosed in FIG. 6 in JP-U S60-42552 does not allow the work to move in an up-down direction during grinding since the elastic member is pressed to the outer circumferential surface of the work. Therefore it is not possible to increase machining accuracy of the work. Also, when the work is placed in the jig, the work must be pressed into the inner circumferential region of the elastic member. This is time consuming and decreases efficiency in the grinding operation.

SUMMARY OF THE INVENTION

Therefore, a primary object of the present invention is to provide a double disc surface grinding machine which is capable of increasing grinding efficiency and machining accuracy on two main surfaces of a work, and to provide a grinding method therefor.

According to an aspect of the present invention, there is provided a double disc surface grinding machine which includes: a pair of grinding wheels opposed to each other, with a distance therebetween in a first direction, to rotate for grinding a work; a clamp member having a non-circular outer circumferential portion and attached to an outer circumferential surface of the work, a storage portion having a non-circular inner circumferential portion engageable with the outer circumferential portion of the clamp member, which houses the clamp member attached to the work, movably in the first direction; a rotation drive section which rotates the storage portion around a first rotation shaft extending in the first direction; and a grinding wheel feeding section which feeds at least one of the grinding wheels onto the work for sandwiching the work with the pair of grinding wheels and grinding two main surfaces of the work.

There is also provided a grinding method for grinding a work with a pair of rotating grinding wheels opposed to each other, with a distance therebetween in a first direction. The method includes: an attaching step of attaching a clamp member having a non-circular outer circumferential portion to an outer circumferential surface of the work, a housing step of housing the clamp member attached to the work into a storage portion having a non-circular inner circumferential portion engageable with the outer circumferential portion of the clamp member, movably in the first direction, a rotation step of rotating the clamp member and the work with the storage portion by rotating the storage portion around a first rotation shaft extending in the first direction and engaging the inner circumferential portion of the storage portion with the outer circumferential portion of the clamp member, and a feeding step of feeding at least one of the grinding wheels onto the work so as to sandwich the work with the pair of grinding wheels for grinding two main surfaces of the work.

According to the invention described above, the clamp member is attached to the outer circumferential surface of the work. The clamp member has the non-circular outer circumferential portion, and the storage portion has the non-circular inner circumferential portion which is engageable with the outer circumferential portion of the clamp member. Therefore, as the clamp member which is attached to the outer circumferential surface of the work is placed into the storage portion, and then the storage portion is rotated, the inner circumferential portion of the storage portion and the outer circumferential portion of the clamp member engage with each other, to serve as an anti-rotation device for the clamp member with respect to the storage portion. As a result, rotation of the storage portion is transmitted to the clamp member, i.e., it is possible to rotate the clamp member and the work together with the storage portion. In this way, it is possible to rotate even a work which is not formed with a recess in its outer circumferential surface, and to improve machining accuracy. The work and the clamp member are placed in the storage portion so as to be able to move in the first direction. In other words, even under a state of being housed in the storage portion, the work and the clamp member are movable easily in the first direction. Therefore, by moving the clamp member attached to the work in, e.g., the first direction, it is possible to place it easily into the storage portion and take it easily out of the storage portion. It is possible with this arrangement to improve grinding efficiency of the two main surfaces of the work. Also, with the arrangement which allows the work to be housed for movement in the first direction, the work is movable in the first direction during grinding operation. This makes it possible, even when both of the main surfaces of the work are wavy for example, to rotate the work while preventing it from wobbling, namely, it is possible to improve machining accuracy on both main surfaces of the work.

Preferably, the double disc surface grinding machine is configured so that a gap is formable between the outer circumferential portion of the clamp member and the inner circumferential portion of the storage portion around the entire circumference under a state where the clamp member attached to the work is housed in the storage portion. In this case, it become easy to place the clamp member attached to the work into the storage portion and take it out of the storage portion, and therefore to further improve grinding efficiency of the two main surfaces of the work. Also, it becomes easier to move the work and the clamp member in the first direction, and therefore to further improve machining accuracy of the two main surfaces of the work.

Further preferably, the inner circumferential portion of the storage portion is elliptical, and the outer circumferential portion of the clamp member is substantially elliptical. In this case, it becomes possible to simplify the shape of outer circumferential portion of the clamp member and the shape of inner circumferential portion of the storage portion, making it easy to manufacture the clamp member and the storage portion.

Further, preferably, the inner circumferential portion of the storage portion is formed substantially rectangular, and the outer circumferential portion of the clamp member is formed substantially rectangular. In this case, it becomes possible to make four engagement points between the clamp member and the storage portion when the storage portion is rotated. The arrangement makes it possible to rotate the work smoothly. It is possible with this arrangement to further improve machining accuracy of the work.

Preferably, the clamp member is formed annular and has a first protrusion protruding radially outward of the clamp member in the outer circumferential portion, and the storage portion has a first recess engageable with the first protrusion in the inner circumferential portion. In this case, as the first protrusion is set into the first recess and the storage portion is rotated, the first protrusion makes engagement with the first recess, making it possible to rotate the clamp member easily with the storage portion. Also, since there is no need for providing the outer circumferential portion of the clamp member with portions protruding radially outward of the clamp member other than the place where the first protrusion is formed, the arrangement makes it possible to reduce a radial thickness of the clamp member. Since this makes it possible to reduce the weight of clamp member, it becomes easier to move the work and the clamp member in the first direction, and to further improve machining accuracy of the two main surfaces of the work.

Further preferably, the clamp member is formed annular and has a second recess recessing radially inward of the clamp member in its outer circumferential portion, and the storage portion has a second protrusion enagageable with the second recess in its inner circumferential portion. In this case, as the second protrusion is set into the second recess and the storage portion is rotated, the second protrusion makes engagement with the second recess, making it possible to rotate the clamp member easily together with the storage portion. Also, since there is no need for providing the outer circumferential portion of the clamp member with portions protruding radially outward of the clamp member, the arrangement makes it possible to reduce the radial thickness of the clamp member. Since this makes it possible to reduce the weight of the clamp member, it becomes easier to move the work and the clamp member in the first direction, and to further improve machining accuracy of the two main surfaces of the work.

Further, preferably, the clamp member has a pair of clamp arms, a first elastic member which connects first end portions of the clamp arms with each other, and a second elastic member which connects second end portions of the clamp arms with each other, and the clamp member is attached to the outer circumferential surface of the work with a clamping action to the work provided by the pair of clamp arms pulled toward each other by the first elastic member and the second elastic member. In this case, the clamp arms are brought closer to each other by the first elastic member and the second elastic member, to clamp the work, whereby the arrangement makes it possible to increase a frictional force generated in the contact region between the clamp member and the work. This ensures reliable transmission of the rotation of the storage portion to the work via the clamp member. Since it is possible to reliably rotate the work in this way, it is possible to further improve machining accuracy of the two main surfaces of the work. Also, since it is possible to move the clamp arms in a direction in which they move away from each other, the clamp member can be removed easily from the work. This further improves grinding efficiency of two main surfaces of the work.

Preferably, the clamp member has a pair of clamp arms having their respective first end portions connected to each other for mutually opening and closing operation, and a third elastic member which connects respective second end portions of the clamp arms to each other, and the clamp member is attached to the outer circumferential surface of the work with a clamping action to the work provided by the pair of clamp arms pulled toward each other by the third elastic member. In this case, the clamp arms are closed to each other by the third elastic member and clamp the work. The arrangement makes it possible to generate a frictional force in the contact region between the clamp member and the work. This ensures reliable transmission of the rotation of the storage portion to the work via the clamp member. Since it is possible to reliably rotate the work in this way, it is possible to further improve machining accuracy of the two main surfaces of the work. Also, one end portions of the clamp arms are connected to each other with a pin, for example, rather than with an elastic member. This makes it possible to open the other end portions of the clamp arms in a direction they move away from each other, with a smaller amount of force. Therefore, it makes it easy to take the clamp member off the work, and to further improve grinding efficiency of the two main surfaces of the work.

Further preferably, the clamp member has a contact member for making contact to the outer circumferential surface of the work, and the contact member has a coefficient of friction greater than those of other parts of the clamp member. In this case, it becomes possible to increase a frictional force generated in the contact region between the clamp member and the outer circumferential surface of the work (area of contact between the contact member and the outer circumferential surface of the work). This ensures reliable transmission of the rotation of the storage portion to the work via the clamp member. Since it is possible to rotate the work more reliably, it is possible to further improve machining accuracy of the two main surfaces of the work.

Further, preferably, the clamp arms are made of an aluminum alloy. In this case, the arrangement makes it possible to reduce the weight of the clamp member, it becomes easy to move the work and the clamp member in the first direction, and to further improve machining accuracy of the two main surfaces of the work. Also, since it is possible to increase strength of the clamp arms, it becomes possible to reduce likelihood of damage to the clamp member even in cases where a large torque is required to rotate the work. Further, since aluminum alloys are easy to work on, manufacturing of the clamp member is easy.

Preferably, the clamp arms are made of a fiber-reinforced plastic. In this case, the arrangement makes it possible to reduce the weight of the clamp member, it becomes easy to move the work and the clamp member in the first direction, and to further improve machining accuracy of the two main surfaces of the work. Also, since it is possible to increase strength of the clamp arms, it becomes possible to reduce likelihood of damage to the clamp member even in cases where a large torque is required to rotate the work. Further, since fiber-reinforced plastics are not likely to corrode, it is possible to use the clamp member for a long time.

Further preferably, the clamp arms are made of a carbon fiber. In this case, the arrangement makes it possible to reduce the weight of the clamp member, it becomes easy to move the work and the clamp member in the first direction, and to further improve machining accuracy of the two main surfaces of the work. Also, since it is possible to increase strength of the clamp arms, it becomes possible to reduce likelihood of damage to the clamp member even in cases where a large torque is required to rotate the work. Further, since carbon fibers have a superior wear resistance, it is possible to use the clamp member for a long time.

Further, preferably, the clamp arms are made of a ferrous steel. In this case, it is possible to increase strength of the clamp arms. This makes it possible to reduce likelihood of damage to the clamp member even in cases where a large torque is required to rotate the work. Also, it is possible to manufacture the clamp member at a low cost.

It should be noted here that in the present invention, the term "two main surfaces of the work" means a pair of surfaces which connect to an outer circumferential surface of the work. For example, in cases where the work is circular annular, the two main surfaces of the work mean the pair of circular annular surfaces (in other words, two surfaces excluding an outer circumferential surface and an inner circumferential surface from all surfaces of the work), whereas in cases where the work is disc-like, the two main surfaces of the work mean the pair of circular surfaces (in other words, two surfaces excluding an outer circumferential surface from all surfaces of the work). Also, the term "non-circular" used in the present invention means any shape other than a circle, and therefore includes, for example, a circular shape but having a region formed with a protrusion or a recess, an elliptical shape, polygons, and those similar thereto.

The above-described object and other objects, characteristics, aspects and advantages of the present invention will become clearer from the following detailed description of embodiments of the present invention to be made with reference to the attached drawings.

BRIEF DESCRIPTION OF THE DRAWINGS

FIG. 1A is a side view, and FIG. 1B is a sectional view taken in line A-A in FIG. 1A.

FIG. 5A is a plan view and FIG. 5B is a sectional view taken in line B-B in FIG. 5A.

FIG. 6A is a side view and FIG. 6B is a plan view.

FIG. 7A is a side view and FIG. 7B is a plan view.

FIG. 12A is a side view and FIG. 12B is a plan view.

FIG. 13A is a side view and FIG. 13B is a plan view.

DETAILED DESCRIPTION OF THE PREFERRED EMBODIMENTS

Hereinafter, embodiments of the present invention will be described with reference to the drawings.

Figure 1A:
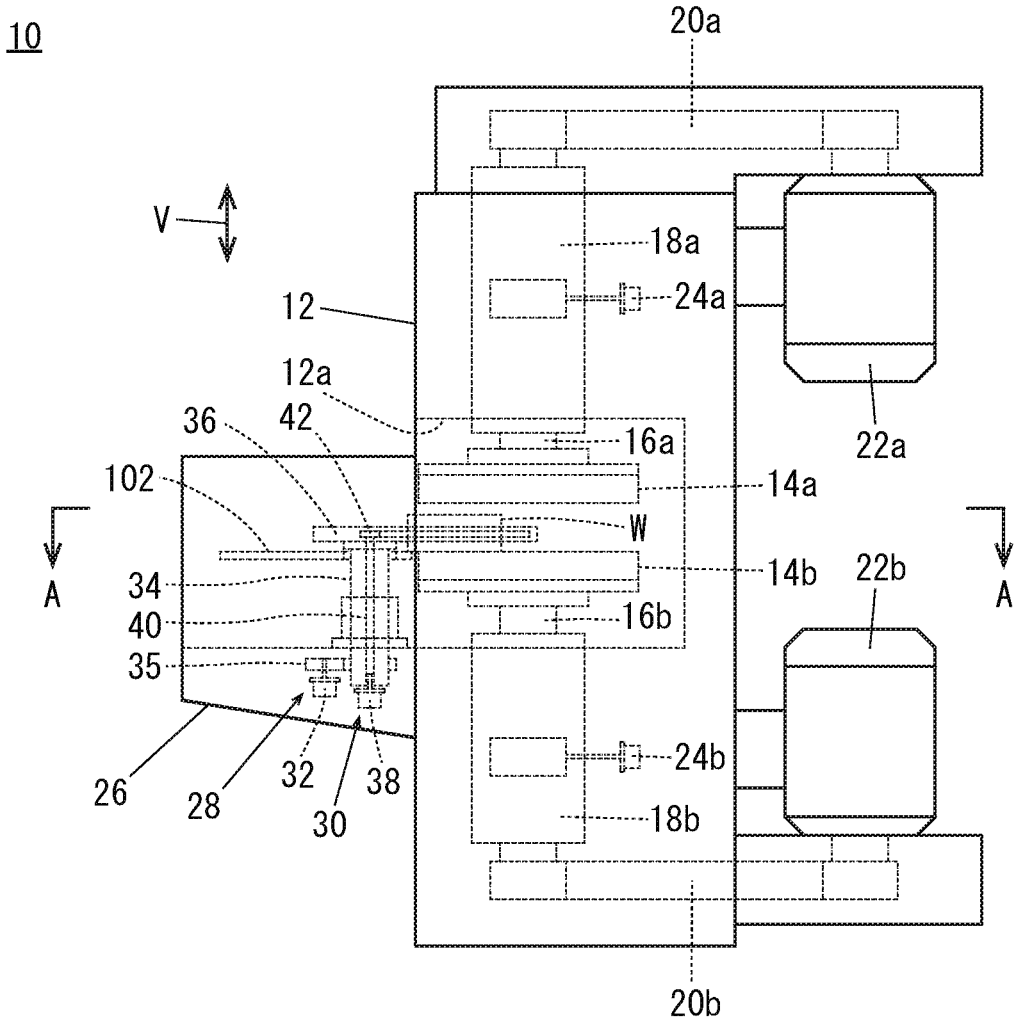
FIG. 1A and FIG. 1B show an upright double disc surface grinding machine according to an embodiment of the present invention.
Figure 1B:
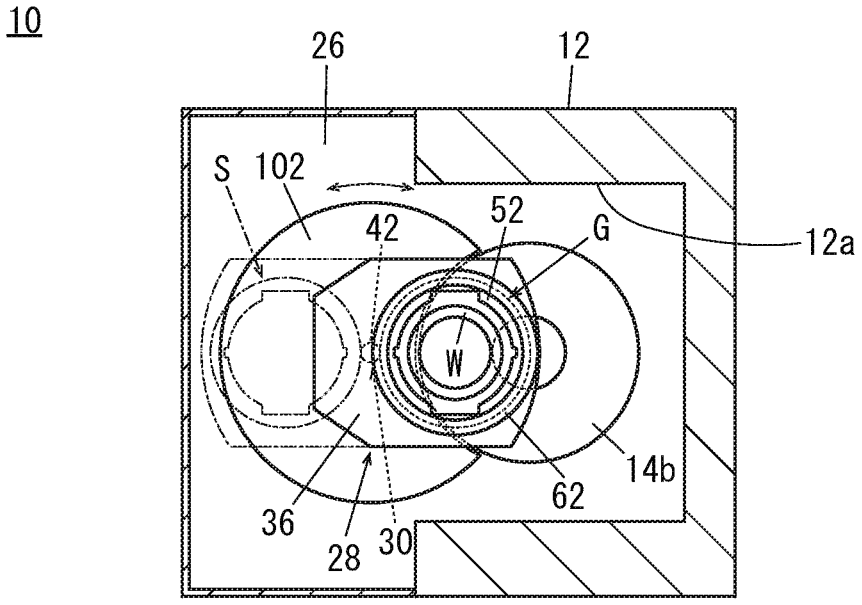

FIG. 1A and FIG. 1B show an upright double disc surface grinding machine 10 according to an embodiment of the present invention: FIG. 1A is a side view, and FIG. 1B is a sectional view taken in line A-A in FIG. 1A. It should be noted here that FIG. 1B does not show part of the arrangement including a drive motor 22*b* which will be described later, for a purpose of avoiding too much complication in the drawing.

Referring to FIG. 1A and FIG. 1B, the upright double disc surface grinding machine (Hereinafter, will simply be called double disc surface grinding machine) 10 includes a column 12 which has a recess 12*a*. The recess 12*a* opens forward (toward a transmission member 42 which will be described later) at a center region of the column 12. Inside the recess 12*a* of the column 12, a pair of grinding wheels 14*a*, 14*b* for grinding a work W is opposed coaxially to each other with a gap therebetween, in an arrow V direction (in an up-down direction in the present embodiment). In the present embodiment, the direction of Arrow V represents the first direction.

In the present embodiment, each of the grinding wheels 14*a*, 14*b* is circular annular in a plan view. Also, in the present embodiment, the work W is circular annular in a plan view. Therefore, the work W has an outer circumferential surface which has a circular section.

The pair of grinding wheels 14*a*, 14*b* are supported by grinding wheel shafts 16*a*, 16*b*. The grinding wheel shafts 16*a*, 16*b* are supported by the grinding wheel shaft units 18*a*, 18*b* rotatably and movably in the up-down direction, and are driven by drive motors 22*a*, 22*b* via belts 20*a*, 20*b*. Therefore, rotational driving forces from the drive motors 22*a*, 22*b* are transmitted via the belts 20*a*, 20*b*, to the grinding wheel shafts 16*a*, 16*b*, whereby the grinding wheels 14*a*, 14*b* are rotated.

The grinding wheel shafts 16*a*, 16*b* are movable in the up-down direction by grinding wheel feeders 24*a*, 24*b*. As the grinding wheel shafts 16*a*, 16*b* are moved by the grinding wheel feeders 24*a*, 24*b* in the up-down direction, the grinding wheels 14*a*, 14*b* are moved in the up-down direction respectively, making it possible to cut onto the work W. It should be noted here that in the present embodiment, the lower grinding wheel 14*b* is pre-positioned as substantially high as an upper surface (a lower surface of the work W before grinding) of a guide plate 102 which will be described later, and will be moved in the up-down direction for fine adjustment when, for example, the grinding wheel 14*b* is worn. In the present embodiment, the grinding wheel feeder 24*a* represents the grinding wheel feeding section.

A front column 26 is disposed adjacent to the column 12. The front column 26 supports a transport unit 28 and a rotation drive unit 30. The transport unit 28 includes a drive motor 32, a drive shaft 34, a transmission member 35 and a rotation plate 36. The rotation drive unit 30 includes a drive motor 38, a drive shaft 40 and the transmission member 42.

In the present embodiment, the rotation drive unit 30 represents the rotation drive section.

Figure 2:
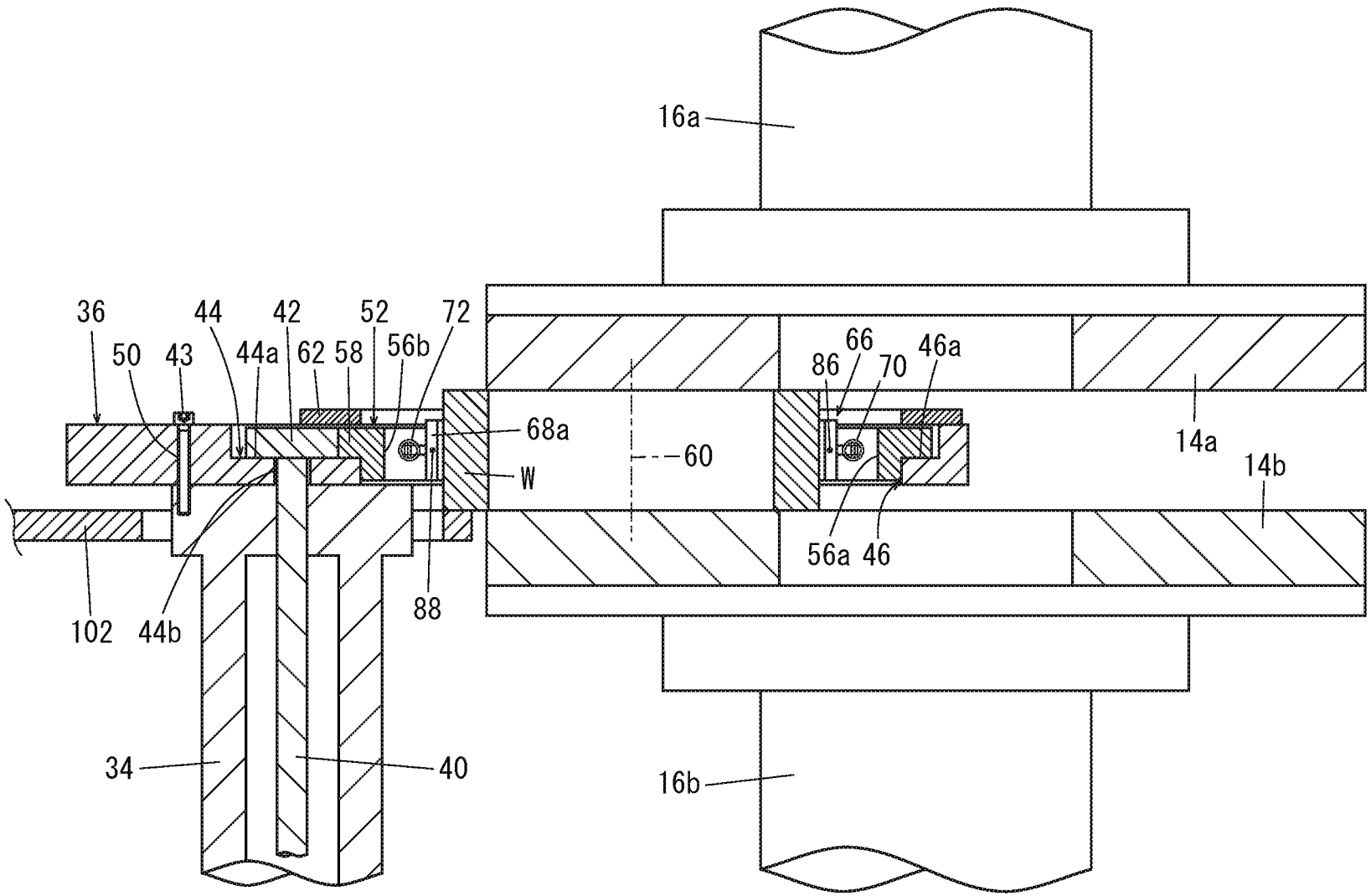
FIG. 2 is an illustrative sectional view which shows an arrangement of a primary portion of the upright double disc surface grinding machine.

FIG. 2 is an illustrative sectional view which shows an arrangement of a primary portion of the double disc surface grinding machine 10.

Referring also to FIG. 2, the drive shaft 34 extends in the up-down direction, and is connected to the drive motor 32 via the transmission member 35. The rotation plate 36 is fixed onto an upper end portion of the drive shaft 34 using bolts 43. In the present embodiment, the rotation plate 36 is placed perpendicularly to the Arrow V direction. Rotation of the drive motor 32 is transmitted via the transmission member 35 to the drive shaft 34 to rotatingly drive the drive shaft 34. The rotation plate 36 rotates around the drive shaft 34 as the center. In the present embodiment, the rotation plate 36 rotates in one direction (e.g., clockwise in a plan view) by 180 degrees to move a storage portion 52, which will be described later, from a supply position S to a grinding position G. As the rotation plate 36 rotates in the other direction by 180 degrees, the storage portion 52 moves from the grinding position G to the supply position S.

Figure 3:
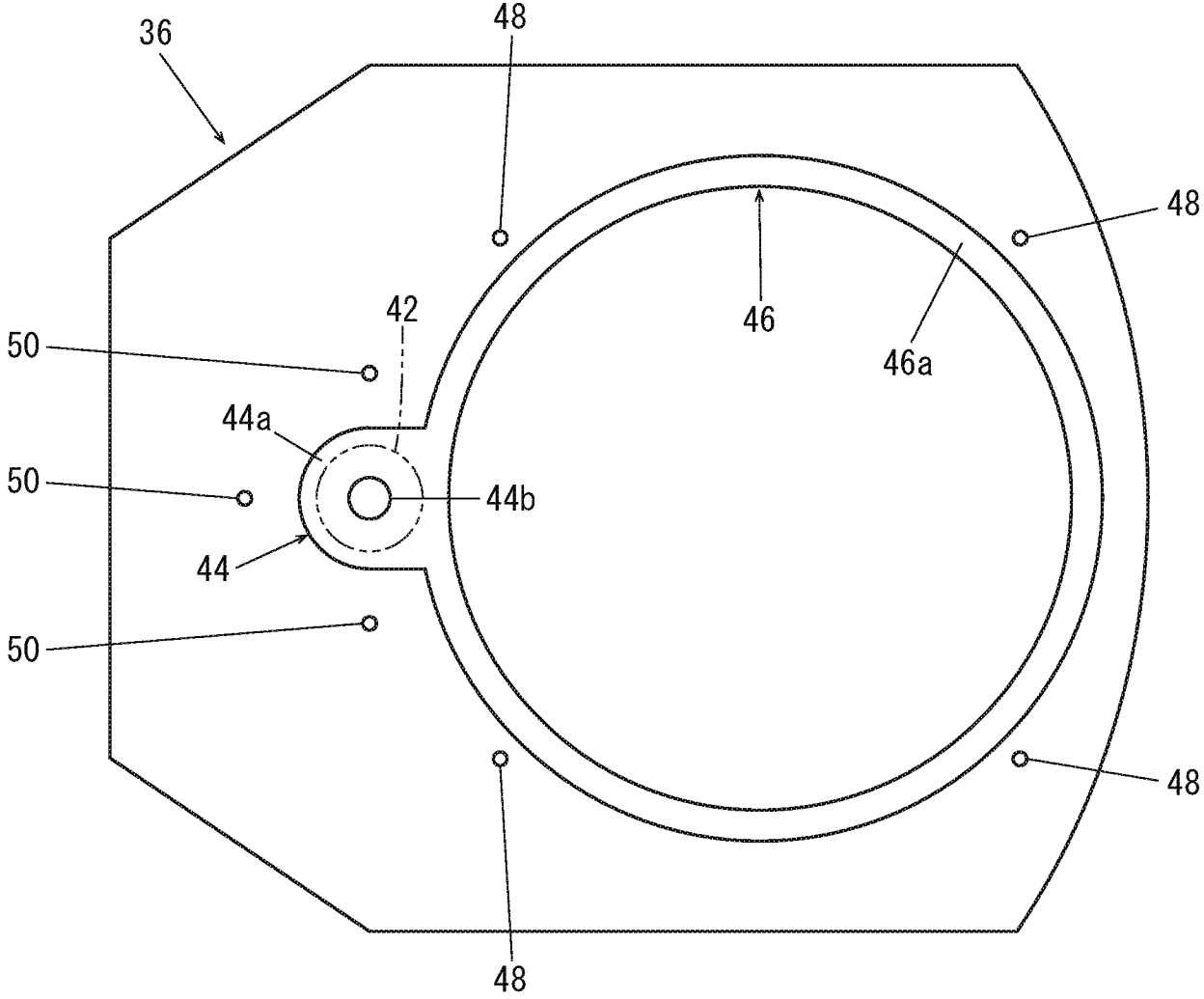
FIG. 3 is a plan view of a rotation plate.
Figure 4:
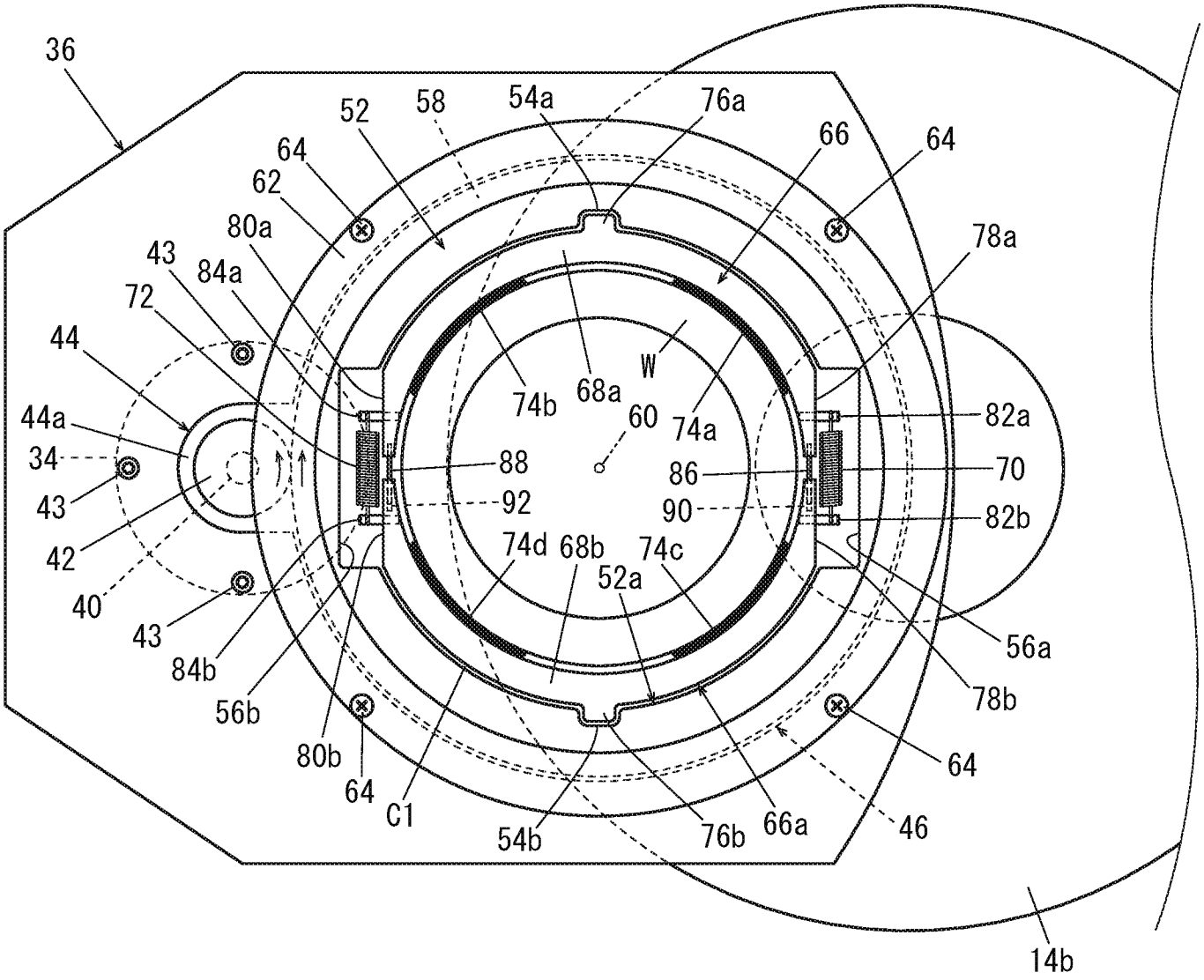
FIG. 4 is a plan view which shows an arrangement of a primary portion of the upright double disc surface grinding machine.

FIG. 3 is a plan view which shows the rotation plate 36. FIG. 4 is a plan view which shows an arrangement of a primary portion of the double disc surface grinding machine 10.

Referring to FIG. 2 through FIG. 4, the rotation plate 36 has a recess 44, a through-hole portion 46, a plurality of (four, in the present embodiment) screw holes 48, and a plurality of (three in the present embodiment) through-holes 50. The recess 44 recesses downward from an upper surface of the rotation plate 36, and has a bottom surface 44*a* and a through-hole 44*b*. The drive shaft 40 is inserted rotatably through the through-hole 44*b*. On the bottom surface 44*a*, the transmission member 42, which is fixed on an upper end portion of the drive shaft 40, is provided rotatably. Without going into detail of the recess 44, the recess 44 is sufficiently large so as to allow the transmission member 42 to rotate, and is continuous to the through-hole portion 46.

Referring to FIG. 2, the drive shaft 34 is hollow. Referring to FIG. 1A, FIG. 1B and FIG. 2, the drive shaft 40 is inserted through the drive shaft 34 to extend in the up-down direction. The drive shaft 40 has its lower end portion connected to the drive motor 38. The drive motor 38 rotatingly drives the drive shaft 40 to rotate the transmission member 42. Though not illustrated to avoid excessive complexity in the drawing, the transmission member 42 is formed with gear grooves in its outer circumferential surface. In other words, in the present embodiment, the transmission member 42 is provided by a gear.

Referring to FIG. 2 and FIG. 3, the through-hole portion 46 penetrates the rotation plate 36 in the up-down direction. The through-hole portion 46 includes a support surface 46*a* which is parallel to the horizontal plane. The support surface 46*a* is substantially circular annular. The support surface 46*a* is connected to a bottom surface 44*a* of the recess 44. In the present embodiment, the recess 44 and the through-hole portion 46 are formed so that the bottom surface 44*a* and the support surface 46*a* are flush with each other.

Referring to FIG. 2 and FIG. 4, the storage portion 52 is annular and is provided at the through-hole portion 46. While details will be described later, the storage portion 52 houses, as shown in FIG. 4, an integrally assembled set of a work W and a clamp band 66 (which will be described later).

Figure 5A:
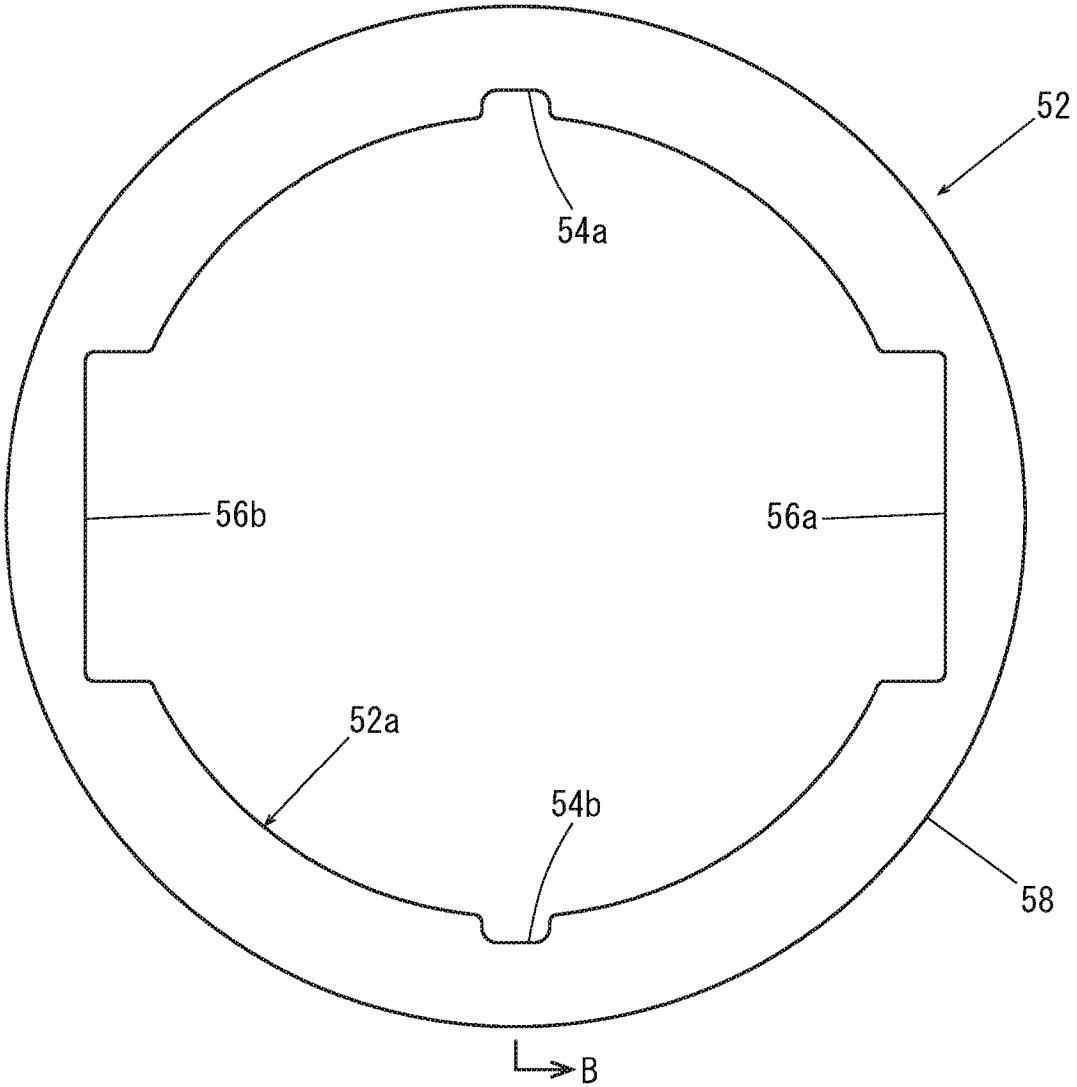
FIG. 5A and FIG. 5B show a storage portion.
Figure 5B:
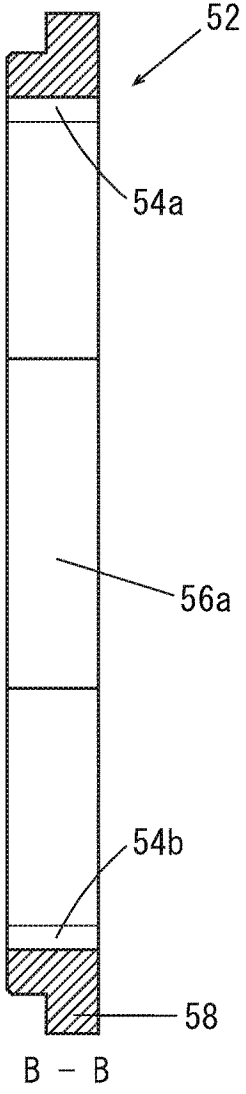

FIG. 5A and FIG. 5B show the storage portion 52: FIG. 5A is a plan view and FIG. 5B is a sectional view taken in line B-B in FIG. 5A.

Referring to FIG. 2, FIG. 4, FIG. 5A and FIG. 5B, the storage portion 52 has a pair of recesses 54*a*, 54*b*, a pair of recesses 56*a*, 56*b*, and a flange portion 58. The recesses 54*a*, 54*b* are like cutouts each recessing in a shape of substantially letter U in a plan view, in an inner circumferential portion 52*a* of the storage portion 52, and are opposed to each other. The recesses 56*a*, 56*b* are like cutouts each recessing in a shape of substantially letter U in a plan view, in an inner circumferential portion 52*a* of the storage portion 52, and are opposed to each other. The recesses 56*a*, 56*b* are located at approximately 90 degrees away from the recesses 54*a*, 54*b* in a circumferential direction of the storage portion 52. The recesses 56*a*, 56*b* are wider and recessing deeper than the recesses 54*a*, 54*b*. As described, the inner circumferential portion 52*a* of the storage portion 52 is non-circular in a plan view for engagement with an outer circumferential portion 66*a* of the clamp band 66. The flange portion 58 protrudes in a flange shape radially outward of the storage portion 52 from an outer circumferential portion on an upper surface side of the storage portion 52. In other words, the flange portion 58 is substantially circular annular in a plan view. The flange portion 58 has unillustrated gear grooves on its outer circumferential surface. Referring to FIG. 2, the flange portion 58 is supported slidably by the support surface 46*a* of the rotation plate 36. The gear grooves of the flange portion 58 and the gear grooves of the transmission member 42 engage with each other. Thus, a rotating drive force of the drive motor 38 is transmitted to the drive shaft 40 and the transmission member 42, and then to the storage portion 52. As a result, the storage portion 52 rotates around a rotation shaft 60 extending in Arrow V direction (up-down direction). In the present embodiment, the recesses 54*a*, 54*b* represent the first recess, whereas the rotation shaft 60 represents the first rotation shaft.

Referring to FIG. 4, in the present embodiment, as the transmission member 42 rotates counterclockwise in a plan view, the storage portion 52 rotates clockwise. It should be noted here that there may be an arrangement where the transmission member 42 rotates clockwise and the storage portion 52 rotates counterclockwise.

Referring to FIG. 2 and FIG. 4, a circular annular guide plate 62 is supported at an upper surface of the rotation plate 36, to cover above the flange portion 58. The guide plate 62 prevents the storage portion 52 from coming off the rotation plate 36. In the present embodiment, the guide plate 62 is fixed to an upper surface of the rotation plate 36 with four screws 64, each inserted through its corresponding through-hole (not illustrated) formed in the guide plate 62 and then threaded to a corresponding one of screw holes 48 (see FIG. 3) in the rotation plate 36.

Figure 6A:
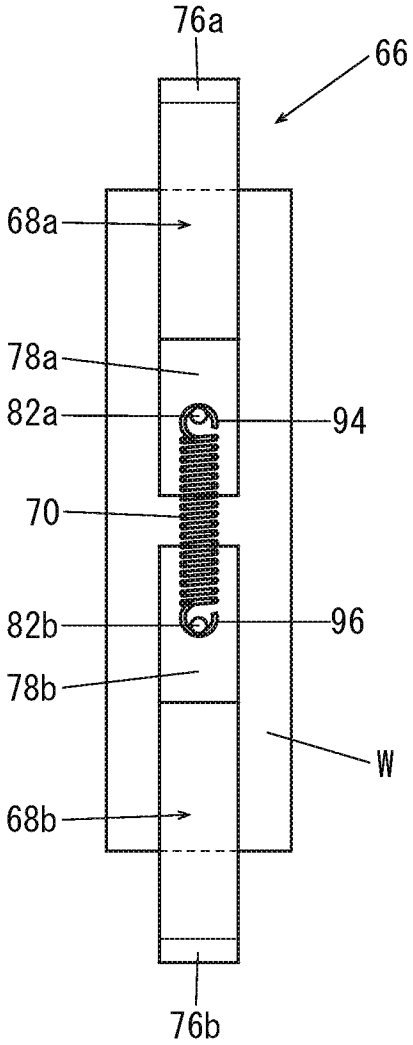
FIG. 6A and FIG. 6B show a clamp band.
Figure 6B:
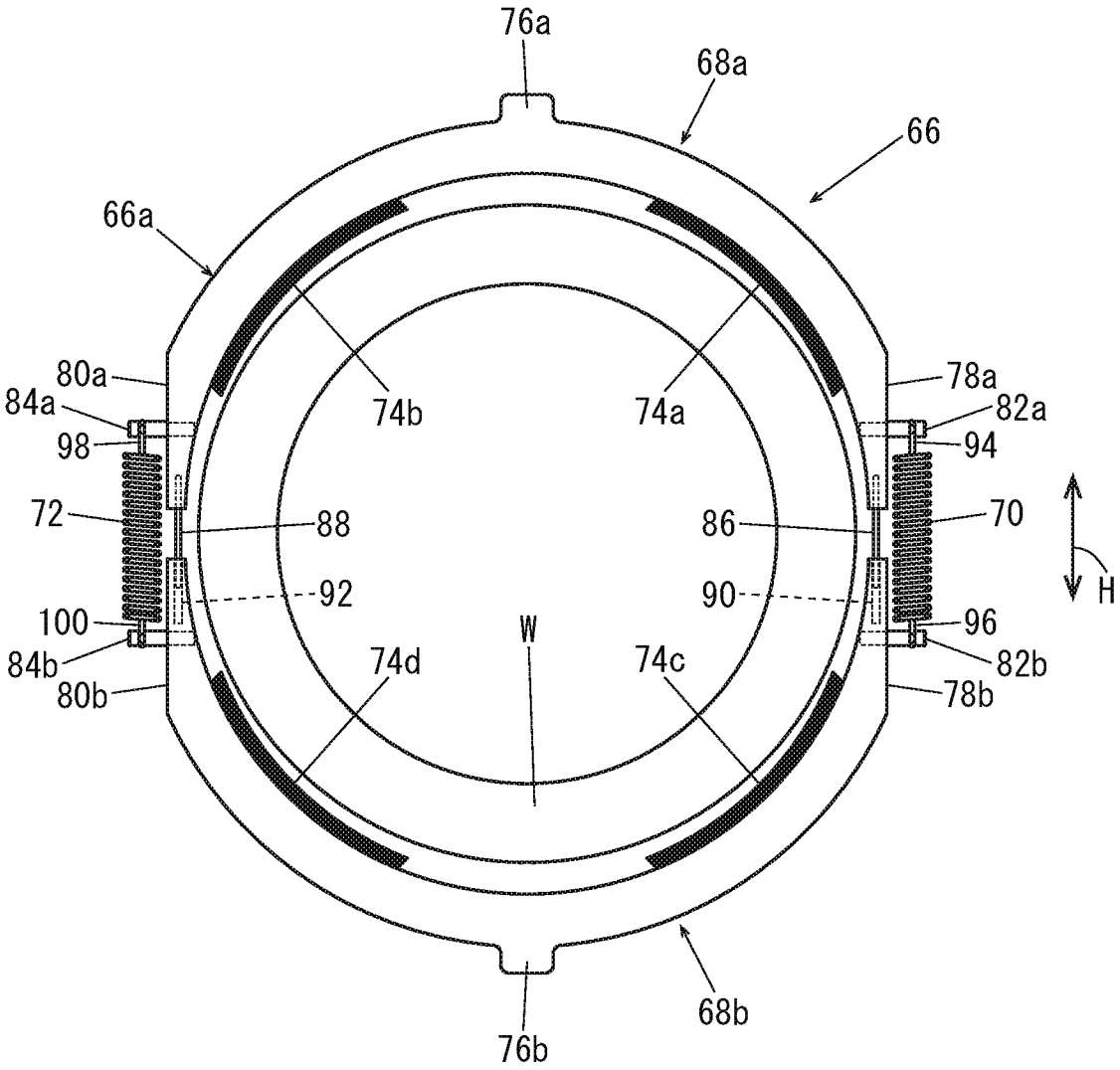

FIG. 6A and FIG. 6B show the clamp band 66: FIG. 6A is a side view and FIG. 6B is a plan view. The clamp band 66 in FIG. 6A and FIG. 6B is in a state immediately before being attached to an outer circumferential surface of the work W. With details to be described later, as shown in FIG. 4, the clamp band 66 becomes integrated with the work W as it is attached to an outer circumferential surface of the work W. In the present embodiment, the clamp band 66 represents the clamp member.

Referring to FIG. 2, FIG. 4, FIG. 6A and FIG. 6B, the clamp band 66 is annular, and has a pair of clamp arms 68*a*, 68*b*, a first elastic member 70, a second elastic member 72, and a plurality (four in the present embodiment) of contact members 74*a* through 74*d*.

Referring to FIG. 6A and FIG. 6B, the clamp arms 68*a*, 68*b* are substantially arc-like, extending in a circumferential direction of the work W, and are opposed to each other. The clamp arm 68*a* has a protrusion 76*a*, flat surface portions 78*a*, 80*a*, posts 82*a*, 84*a*, and pins 86, 88. The protrusion 76*a* protrudes radially outward of the clamp band 66 from a center in the circumferential direction of the clamp arm 68*a* in an outer circumferential portion of the clamp arm 68*a*. Further, the protrusion 76*a* is slightly smaller than the recesses 54*a*, 54*b* to allow engagement with the recess 54*a* or 54*b*. The flat surface portion 78*a* is formed as a flat surface to connect an upper surface and a lower surface of the clamp arm 68*a* to each other on one end portion side in a circumferential direction of the clamp arm 68*a*, and extends in Arrow H direction (axially of the pins 86, 88 in the present embodiment). The flat surface portion 80*a* is formed as a flat surface to connect the upper surface and the lower surface of the clamp arm 68*a* with each other on another end portion side in the circumferential direction of the clamp arm 68*a*, and extends in Arrow H direction. The post 82*a* is erected at a substantial center of the flat surface portion 78*a* substantially perpendicularly to the flat surface portion 78*a*. The post 84*a* is erected at a substantial center of the flat surface portion 80*a* substantially perpendicularly to the flat surface portion 80*a*. The pin 86 extends like a rod in Arrow H direction at an end portion in the circumferential direction of the clamp arm 68*a*. The pin 88 extends like a rod in Arrow H direction at another end portion in the circumferential direction of the clamp arm 68*a*. The clamp arm 68*b* has the protrusion 76*b*, flat surface portions 78*b*, 80*b*, posts 82*b*, 84*b*, and pin holes 90, 92. The protrusion 76*b* has the same shape and size as the protrusion 76*a*; the flat surface portions 78*b*, 80*b* have the same shape and size as the flat surface portions 78*a*, 80*a*; and the posts 82*b*, 84*b* have the same shape and size as the posts 82*a*, 84*a*, so details will not be repeated. The pin hole 90 extends in Arrow H direction at an end portion in the circumferential direction of the clamp arm 68*b*. The pin hole 90 has a diameter slightly larger than that of the pin 86, and the pin 86 is inserted slidably into the pin hole 90. The pin hole 92 extends in Arrow H direction at another end portion in the circumferential direction of the clamp arm 68*b*. The pin hole 92 has a diameter slightly larger than that of the pin 88, and the pin 88 is inserted slidably into the pin hole 92. In the present embodiment, the protrusions 76*a*, 76*b* represent the first protrusion, and the clamp arms 68*a*, 68*b* are made of an aluminum alloy.

The first elastic member 70 and the second elastic member 72 may be provided by any of various kinds of conventional springs (e.g., pull spring) having two end portions formed with hooks. The first elastic member 70 has its hooks 94, 96 engaged with the posts 82*a*, 82*b*, thereby connecting the pair of clamp arms 68*a*, 68*b* with each other at their two mutually opposed end portions (first end portions). The second elastic member 72 has the same shape and size as the first elastic member 70, with its hooks 98, 100 engaged with the posts 84*a*, 84*b*, thereby connecting the pair of clamp arms 68*a*, 68*b* with each other at their two mutually opposed end portions (second end portions).

The contact members 74*a* through 74*d* are formed in an inner circumferential portion of the clamp band 66, each in a strip-like shape, for making contact with an outer circumferential surface of the work W under a state where the clamp band 66 is attached to an outer circumferential surface of the work W. In the circumferential direction of the clamp arm 68*a*, the contact member 74*a* is provided on one end portion side and the contact member 74*b* is on another end portion side. In the circumferential direction of the clamp arm 68*b*, the contact member 74*c* is provided on one end portion side and the contact member 74*d* is on another end portion side. The contact members 74*a* through 74*d* are attached to the clamp arms 68*a*, 68*b* respectively by means of, e.g., adhesive or screw. The contact members 74*a* through 74*d* are designed to have a greater coefficient of friction than coefficient of frictions of other parts of the clamp band 66 (at least of the clamp arms 68*a*, 68*b*). In the present embodiment, the contact members 74*a* through 74*d* are made of rubber.

As is clear from FIG. 4, the outer circumferential portion 66*a* of the clamp band 66 is non-circular in a plan view, and is slightly smaller than the inner circumferential portion 52*a* of the storage portion 52 for engagement with the inner circumferential portion 52*a* of the storage portion 52.

Referring to FIG. 1A and FIG. 1B, the guide plate 102 is below the rotation plate 36. The guide plate 102 has its upper surface at substantially the same height as a grinding surface (upper surface) of the grinding wheel 14*b*. The guide plate 102 prevents the assembly of the work W and the clamp band 66 from falling. Also, when the work W is moved between the supply position S and the grinding position G by the rotation plate 36, the guide plate 102 allows a lower surface of the work W to glide along an upper surface of the guide plate 102 thereby guiding the work W to the supply position S or the grinding position G.

Referring to FIG. 4, FIG. 6A and FIG. 6B, description will be made for a method of attaching the clamp band 66 to the outer circumferential surface of the work W.

First, as shown in FIG. 6A and FIG. 6B, the clamp arms 68*a*, 68*b* are moved in a direction to be away from each other, and the work W is disposed between the clamp arms 68*a*, 68*b*. In this process, the pin 86 slides along the pin hole 90 and the pin 88 slides along the pin hole 92, allowing the clamp arms 68*a*, 68*b* to move in Arrow H direction to move away from each other. Also, in this process, the first elastic member 70 and the second elastic member 72 are stretched in Arrow H direction. Next, the clamp arms 68*a*, 68*b* are allowed to come closer to each other by contracting forces from the first elastic member 70 and the second elastic member 72, and as shown in FIG. 4 the contact members 74*a* through 74*d* are pressed onto the outer circumferential surface of the work W. Because of this arrangement where the pair of clamp arms 68*a*, 68*b* are pulled by the first elastic member 70 and the second elastic member 72 to come closer to each other and to clamp the work W as described above, it is possible to press the contact members 74*a* through 74*d* onto the outer circumferential surface of the work W with a sufficient amount of force. As described, it is possible, with a simple structure, to attach the clamp band 66 around the outer circumferential surface of the work W to assemble the work W and the clamp band 66 integrally with each other. It should be noted here that the step of attaching the clamp band 66 to the outer circumferential surface of the work W does not have to be made at the double disc surface grinding machine 10 but may be performed anywhere convenient for the step, so the clamp band 66 can be attached easily to the outer circumferential surface of the work W.

Referring to FIG. 2 and FIG. 4, description will cover how to place the clamp band 66 into the storage portion 52.

When placing the integrated assembly of the work W and the clamp band 66 into the storage portion 52, the clamp band 66 is fitted into the inner circumferential portion 52*a* of the storage portion 52 so that the protrusion 76*a*, 76*b* fit into the recesses 54*a*, 54*b* respectively. In this process, the first elastic member 70 and the posts 82*a*, 82*b* come inside the recess 56*a*, while the second elastic member 72 and the posts 84*a*, 84*b* come inside the recess 56*b*, making it possible to form a gap C1 between the inner circumferential portion 52*a* of the storage portion 52 and the outer circumferential portion 66*a* of the clamp band 66 around the entire circumference. The gap C1 formed as described allows the work W and the clamp band 66 to move in Arrow V direction even while they are housed in the storage portion 52. Also, as the storage portion 52 rotates around the rotation shaft 60, the protrusion 76*a* makes engagement with the recess 54*a*, and the protrusion 76*b* makes engagement with the recess 54*b*, functioning as an anti-rotation device for the clamp band 66 with respect to the storage portion 52, allowing rotation of the storage portion 52 to be transmitted to the clamp band 66. In an axial direction of the work W, the storage portion 52 and the clamp band 66 have their thickness formed smaller than that of the work W. The integrated assembly of the work W and the clamp band 66 becomes removable from the storage portion 52 if it is moved upward, i.e., in Arrow V direction.

Next, a primary operation of the double disc surface grinding machine 10 will be described with reference to FIG. 1A, FIG. 1B, FIG. 2 and FIG. 4.

First, with an unillustrated work clamp band attaching apparatus, the method described above is followed to attach the clamp band 66 to the outer circumferential surface of the work W, whereby an integrated assembly of the work W and the clamp band 66 is prepared. Following the method described above, the assembled work W and clamp band 66 is then fitted into the inner circumferential portion 52*a* of the storage portion 52 located at the supply position S, to house the assembly in the storage portion 52.

Next, the work W and the clamp band 66 housed in the storage portion 52 is moved into a space between a pair of grinding wheels 14*a*, 14*b* by the transport unit 28. Specifically, the rotation plate 36 rotates by 180 degrees, thereby transporting the work W and the clamp band 66, which is housed in the storage portion 52, from the supply position S to the grinding position G.

After the transport, the rotation drive unit 30 rotates the storage portion 52, the clamp band 66 and the work W. Specifically, a rotating drive force of the drive motor 38 is transmitted to the drive shaft 40 and the transmission member 42, and then to the storage portion 52 to turn the clamp band 66 together with the storage portion 52. The work W in an integrally assembled state with the clamp band 66 rotates integrally with the storage portion 52 and the clamp band 66.

Subsequently, the drive motors 22*a*, 22*b* rotate the grinding wheels 14*a*, 14*b* while the grinding wheel feeder 24*a* quickly lowers the upper grinding wheel 14*a* to a predetermined position (at which the grinding wheel 14*a* is about to make contact with the work W, in the present embodiment).

Then, a cutting speed (lowering speed) of the grinding wheel 14*a* is slowed down to a predetermined rough grinding speed and the pair of grinding wheels 14*a*, 14*b* perform rough grinding of two main surfaces of the work W. Although the grinding wheels 14*a*, 14*b* sandwich only part of the work W at any moment, the work W is rotating and therefore all regions of the surfaces of the work W which must be ground pass through the space between the grinding wheels 14*a*, 14*b* and are ground.

When the rough grinding is complete to a predetermined cutting location, the cutting speed of the grinding wheel 14*a* is slowed down to a predetermined fine grinding speed, and the grinding wheels 14*a*, 14*b* perform fine grinding on both main surfaces of the work W. When the fine grinding is complete to a predetermined cutting location (representing a finished size), lowering of the grinding wheel 14*a* is stopped and spark-out is performed.

After a predetermined spark-out time, the grinding wheel feeder 24*a* quickly lifts the upper grinding wheel 14*a* to its original position. Almost simultaneously with start of the lifting of the grinding wheel 14*a*, the transport unit 28 moves the work W and the clamp band 66 which are housed in the storage portion 52 out of the space between the grinding wheels 14*a*, 14*b*. Specifically, the rotation plate 36 rotates by 180 degrees, thereby transporting the work W and the clamp band 66, which is housed in the storage portion 52, from the grinding position G to the supply position S.

Finally, the assembly of the work W and the clamp band 66 is moved upward, i.e., in Arrow V direction and is removed from the storage portion 52. In cases where a plurality of works W are to be ground, a plurality of the clamp bands 66 may be prepared, and each of the works W may have the clamp band 66 attached in advance, so that a finished work W can be quickly replaced with a work W to be machined.

According to the double disc surface grinding machine 10, the clamp band 66 is attached to the outer circumferential surface of the work W. The clamp band 66 has the non-circular outer circumferential portion 66*a*, while the storage portion 52 has the non-circular inner circumferential portion 52*a* engageable with the outer circumferential portion 66*a* of the clamp band 66. Therefore, as the clamp band 66 is attached to the outer circumferential surface of the work W, placed into the storage portion 52, and then the storage portion 52 is rotated, the inner circumferential portion 52*a* of the storage portion 52 and the outer circumferential portion 66*a* of the clamp band 66 engage with each other, functioning as an anti-rotation device for the clamp band 66 with respect to the storage portion 52. As a result, rotation of the storage portion 52 is transmitted to the clamp band 66, making it possible to rotate the clamp band 66 and the work W together with the storage portion 52. In this way, it is possible to rotate even a work W which is not formed with a recess in its outer circumferential surface, and to improve machining accuracy. The work W and the clamp band 66 are placed in the storage portion 52 in such a manner that they can be moved in Arrow V direction. In other words, even under a state of being housed in the storage portion 52, it is possible to move the work W and the clamp band 66 easily in Arrow V direction. Therefore, by moving the clamp band 66 attached to the work Win, e.g., Arrow V direction, it is possible to place it easily inside the storage portion 52 and take it easily out of the storage portion 52. This makes it possible to improve grinding efficiency for both of the main surfaces of the work W. Also, with the arrangement which allows housing of the work W for movement in Arrow V direction, the work W is movable in Arrow V direction during grinding operation. This makes it possible, even when both of the main surfaces of the work W are wavy for example, to rotate the work W while preventing it from wobbling. Namely, it is possible to improve machining accuracy on both main surfaces of the work W.

The double disc surface grinding machine 10 is arranged in such a fashion that it is possible to forma gap C1 between the outer circumferential portion 66*a* of the clamp band 66 and the inner circumferential portion 52*a* of the storage portion 52 around the entire circumference under the state that the clamp band 66 is attached to the work W and housed in the storage portion 52. This makes it easy to place the clamp band 66, which is attached to the work W into the storage portion 52, as well as taking it out of the storage portion 52, making it possible to further improve grinding efficiency of both main surfaces of the work W. It is also possible to make it even easier to move the work W and the clamp band 66 in Arrow V direction, and therefore further improve machining accuracy of the two main surfaces of the work W.

The contact members 74*a* through 74*d* of the clamp band 66 have a greater coefficient of friction than those of the other parts of the clamp band 66. This makes it possible to increase a frictional force generated in the contact region between the clamp band 66 and the outer circumferential surface of the work W (area of contact between the contact members 74*a* through 74*d* and the outer circumferential surface of the work W). This ensures reliable transmission of the rotation of the storage portion 52 to the work W via the clamp band 66. Since this makes it possible to rotate the work W more reliably, the arrangement makes it possible to further improve machining accuracy of the two main surfaces of the work W. Also, since each of the contact members 74*a* through 74*d* makes surface contact with the outer circumferential surface of the work W, it is possible to further increase the frictional force generated between the contact members 74*a* through 74*d* and the work W. This ensures even more reliable transmission of the rotation of the storage portion 52 to the work W via the clamp band 66.

Since the clamp arms 68*a*, 68*b* are made of an aluminum alloy, it is possible to reduce the weight of the clamp band 66, to make it easier to move the work W and the clamp band 66 in Arrow V direction, and to further improve machining accuracy of the two main surfaces of the work W. Also, since it is possible to increase strength of the clamp arms 68*a*, 68*b*, it is possible to reduce likelihood of damage to the clamp band 66 even in cases where a large torque is required to rotate the work W. Further, since aluminum alloys are easy to work on, manufacturing of the clamp band 66 is easy.

All of the functions and advantages described above are also offered by double disc surface grinding machines which make use of storage portions and clamp bands that are shown in FIG. 7A through FIG. 13B and will be described later.

As the protrusions 76*a*, 76*b* are set into the recesses 54*a*, 54*b* and the storage portion 52 is rotated, the protrusion 76*a* makes engagement with the recess 54*a* and the protrusion 76*b* makes engagement with the recess 54*b*, making it possible to rotate the clamp band 66 easily together with the storage portion 52. There is no need for providing the outer circumferential portion 66*a* of the clamp band 66 (outer circumferential portions of the clamp arms 68*a*, 68*b*) with portions which protrude radially outward of the clamp band 66 other than the places where the protrusions 76*a*, 76*b* are formed. This makes it possible to reduce the thickness in radial direction of the clamp band 66. Since this makes it possible to reduce the weight of the clamp band 66, it becomes even easier to move the work W and the clamp band 66 in Arrow V direction, and it is possible to further improve machining accuracy of the two main surfaces of the work W. The same advantage is also offered by a double disc surface grinding machine which makes use of a storage portion 104 and a clamp band 106 that are shown in FIG. 7A through FIG. 7B and will be described later.

The clamp arms 68*a*, 68*b* are brought closer to each other by the first elastic member 70 and the second elastic member 72, to clamp the work W. This arrangement makes it possible to increase the frictional force generated in the contact region between the clamp band 66 and the work W. This ensures reliable transmission of the rotation of the storage portion 52 to the work W via the clamp band 66. Because it is possible to reliably rotate the work W as described, the invention is capable of further improving machining accuracy of the two main surfaces of the work W. Also, since it is possible to move the clamp arms 68*a*, 68*b* in the direction in which they move away from each other, it is easy to remove the clamp band 66 from the work W. This further improves grinding efficiency of both main surfaces of the work W. The same advantage is also offered by double disc surface grinding machines which make use of storage portions and clamp bands that are shown in FIG. 8 through FIG. 13B and will be described later.

Hereinafter, other examples of the storage portion and the clamp band will be described. It should be noted here that parts and components equivalent to the earlier-described storage portion 52 and clamp band 66 will be indicated with the same reference symbols and their description will not be repeated.

Figure 7A:
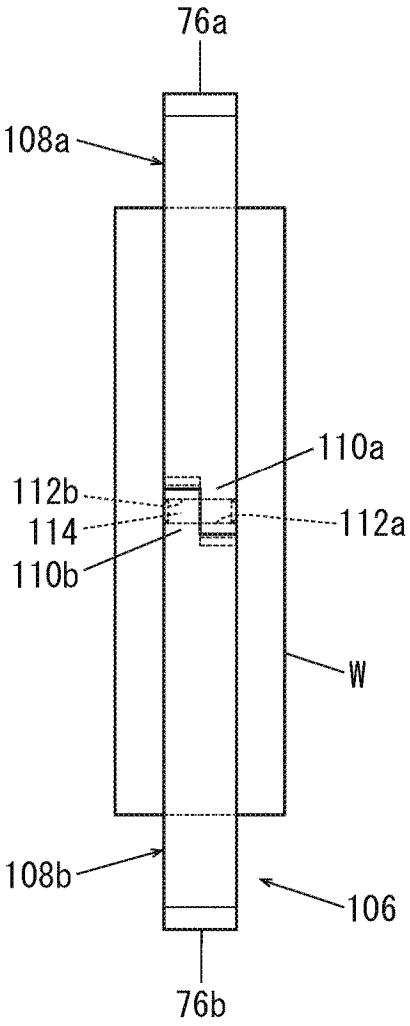
FIG. 7A and FIG. 7B show another example of the storage portion and the clamp band.
Figure 7B:
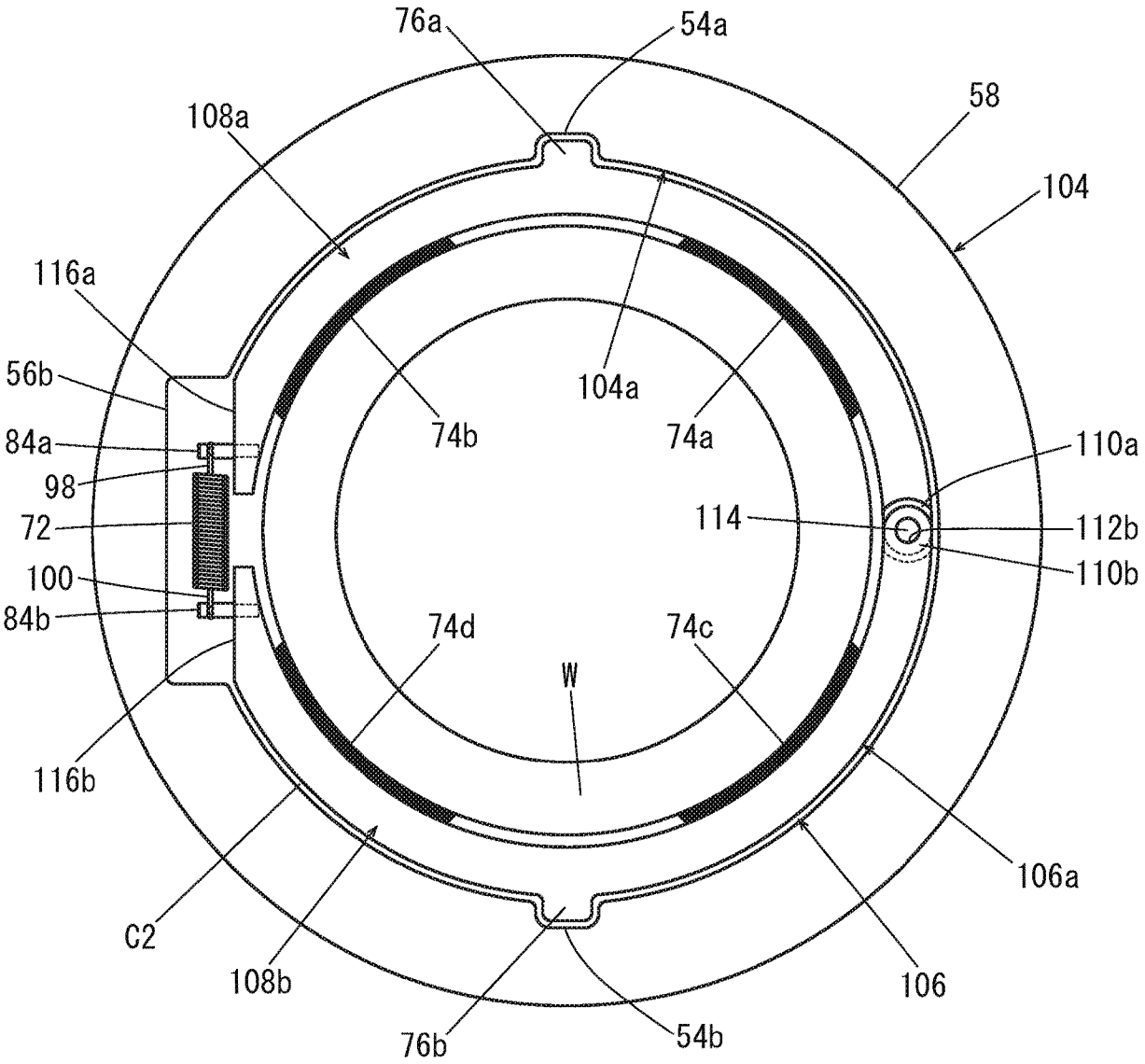

FIG. 7A and FIG. 7B show a storage portion 104, a clamp band 106 and a work W: FIG. 7A is a side view and FIG. 7B is a plan view. For a purpose of avoiding too much complication in the drawing, FIG. 7A does not show the storage portion 104.

The storage portion 104 does not have the recess 56*a* but otherwise is the same as the storage portion 52, so no more description will be made here.

The clamp band 106 has a pair of clamp arms 108*a*, 108*b*. The clamp arms 108*a*, 108*b* are substantially arc-like, extend in a circumferential direction of the work W, and have thin-wall portions 110*a*, 110*b* for mutual overlap at their respective end portions (first end portions) in the circumferential direction. The thin-wall portions 110*a*, 110*b* have penetrating pin holes 112*a*, 112*b*, through which a pin 114 is inserted to connect the clamp arms 108*a*, 108*b* to each other, for their mutual opening and closing operation with the pin 114 serving as a pivot shaft. The clamp arms 108*a*, 108*b* are provided with posts 84*a*, 84*b* erected at other end portions (second end portions) in the circumferential direction, at locations slightly off the center of the flat surface portions 116*a*, 116*b* toward the ends. All the other arrangements of the clamp band 106 are the same as the clamp band 66, so the description will not be repeated here. In this embodiment, the second elastic member 72 represents the third elastic member.

When the integrally assembled work W and clamp band 106 is housed in the storage portion 104, it becomes possible to form a gap C2 between the inner circumferential portion 104*a* of the storage portion 104 and the outer circumferential portion 106*a* of the clamp band 106 around the entire circumference.

In this embodiment, the clamp arms 108*a*, 108*b* are mutually opened and closed around the pin 112 as a pivot shaft to attach the clamp band 106 to the outer circumferential surface of the work W, whereby the work W and the clamp band 106 are integrally assembled with each other.

According to the double disc surface grinding machine which makes use of the storage portion 104 and the clamp band 106 as described, the clamp arms 108*a*, 108*b* are closed to each other by the second elastic member 72 to clamp the work W, whereby it is possible to generate a frictional force in a contact region between the clamp band 106 and the work W. This ensures reliable transmission of the rotation of the storage portion 104 to the work W via the clamp band 106. Because it is possible to reliably rotate the work W as described, the invention is capable of further improving machining accuracy of the two main surfaces of the work W. Also, one end portions of the clamp arms 108*a*, 108*b* are connected to each other with the pin 114 rather than with an elastic member. This makes it possible to open the other end portions of the clamp arms 108*a*, 108*b* in a direction they move away from each other, with a smaller amount of force.

Thus, it is possible to remove the clamp band 106 easily from the work W, and to further improve grinding efficiency of the two main surfaces of the work W.

Figure 8:
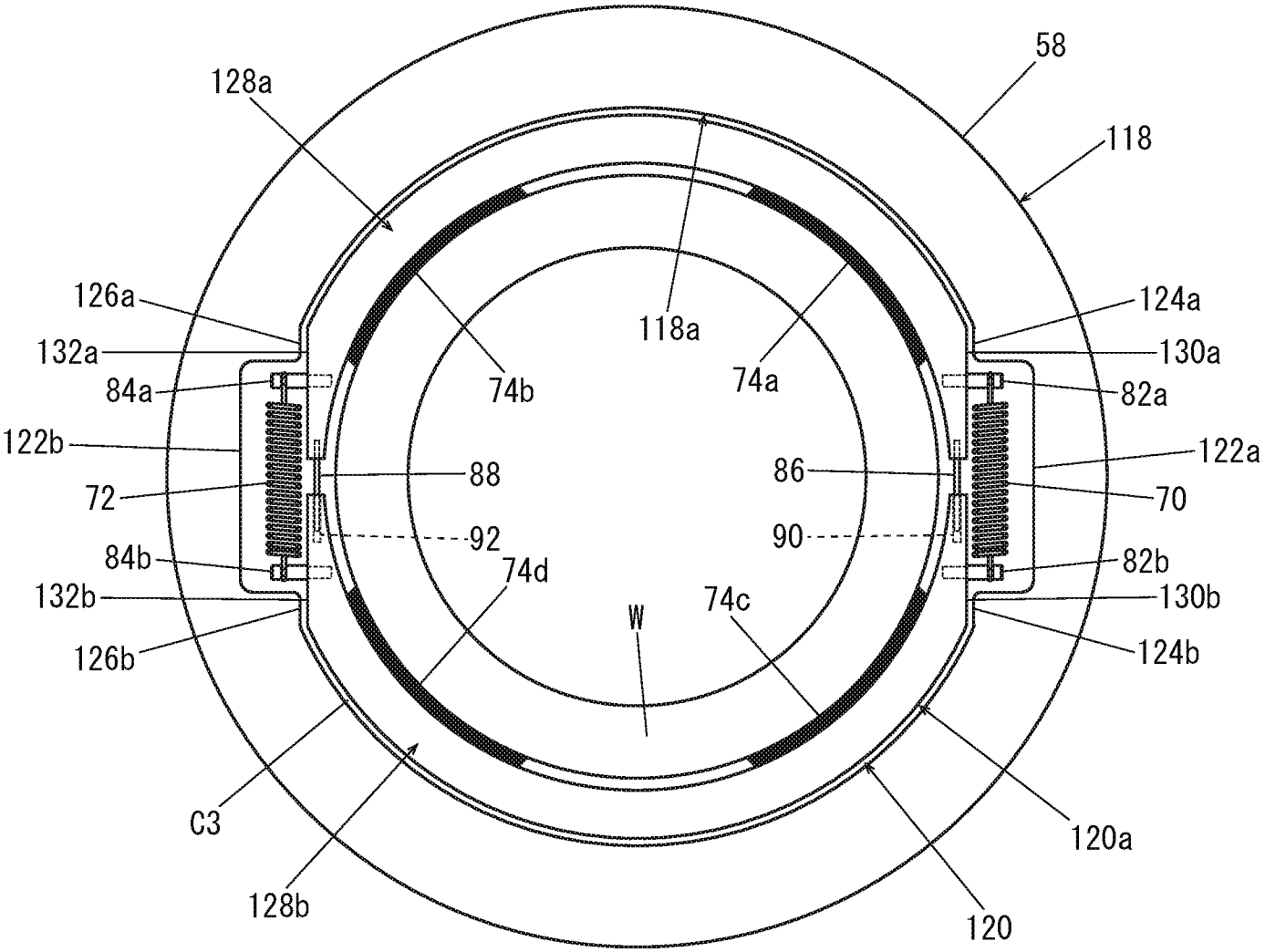
FIG. 8 is a plan view which shows another example of the storage portion and the clamp band.

FIG. 8 is a plan view which shows a storage portion 118, a clamp band 120 and a work W.

The storage portion 118 has recesses 122*a*, 122*b*, flat surface portions 124*a*, 124*b* formed on two sides of the recess 122*a*, and flat surface portions 126*a*, 126*b* formed on two sides of the recess 122*b*. The flat surface portions 124*a*, 124*b* extend to oppose to flat surface portions 130*a*, 130*b* of a clamp band 120 which will be described later. The flat surface portions 126*a*, 126*b* extend to oppose to flat surface portions 132*a*, 132*b* of the clamp band 120 which will be described later. The storage portion 118 does not have the recesses 54*a*, 54*b*, 56*a*, 56*b* but otherwise is the same as the storage portion 52, so no more description will be made here.

The clamp band 120 has a pair of clamp arms 128*a*, 128*b*. The clamp arms 128*a*, 128*b* have flat surface portions 130*a*, 130*b* formed at their first end portions in the circumferential direction; and have flat surface portions 132*a*, 132*b* formed at their second end portions in the circumferential direction. Posts 82*a*, 82*b* are erected at locations slightly off the center of the flat surface portions 130*a*, 130*b*, away from the ends. Posts 84*a*, 84*b* are erected at locations slightly off the center of the flat surface portions 132*a*, 132*b*, away from the ends. The clamp band 120 does not have the protrusions 76*a*, 76*b* but otherwise is the same as the clamp band 66, so no more description will be made here.

When the integrally assembled work W and clamp band 120 is housed in the storage portion 118, it becomes possible to form a gap C3 between the inner circumferential portion 118*a* of the storage portion 118 and the outer circumferential portion 120*a* of the clamp band 120 around the entire circumference.

In this embodiment, the flat surface portions 124*a*, 124*b*, 126*a*, 126*b* are formed in storage portion 118 so as to oppose to the flat surface portions 130*a*, 130*b*, 132*a*, 132*b* of the clamp band 120. Therefore, when the storage portion 118 is rotated clockwise, the flat surface portion 124*b* makes engagement with the flat surface portion 130*b*, and the flat surface portion 126*a* makes engagement with the flat surface portion 132*a*, to function as an anti-rotation device for the clamp band 120 with respect to the storage portion 118, making it possible to rotate the clamp band 120 easily with the storage portion 118. Likewise, when the storage portion 118 is rotated counterclockwise, the flat surface portion 124*a* makes engagement with the flat surface portion 130*a* and the flat surface portion 126*b* makes engagement with the flat surface portion 132*b*, to function as an anti-rotation device for the clamp band 120 with respect to the storage portion 118, making it possible to rotate the clamp band 120 easily with the storage portion 118.

According to the double disc surface grinding machine which makes use of the storage portion 118 and the clamp band 120 described above, there is no need for forming protrusions in the clamp band 120, namely, it is possible to reduce the weight of the clamp band 120. This makes it possible to easily move the work W in Arrow V direction, and to improve machining accuracy of the two main surfaces of the work W.

Figure 9:
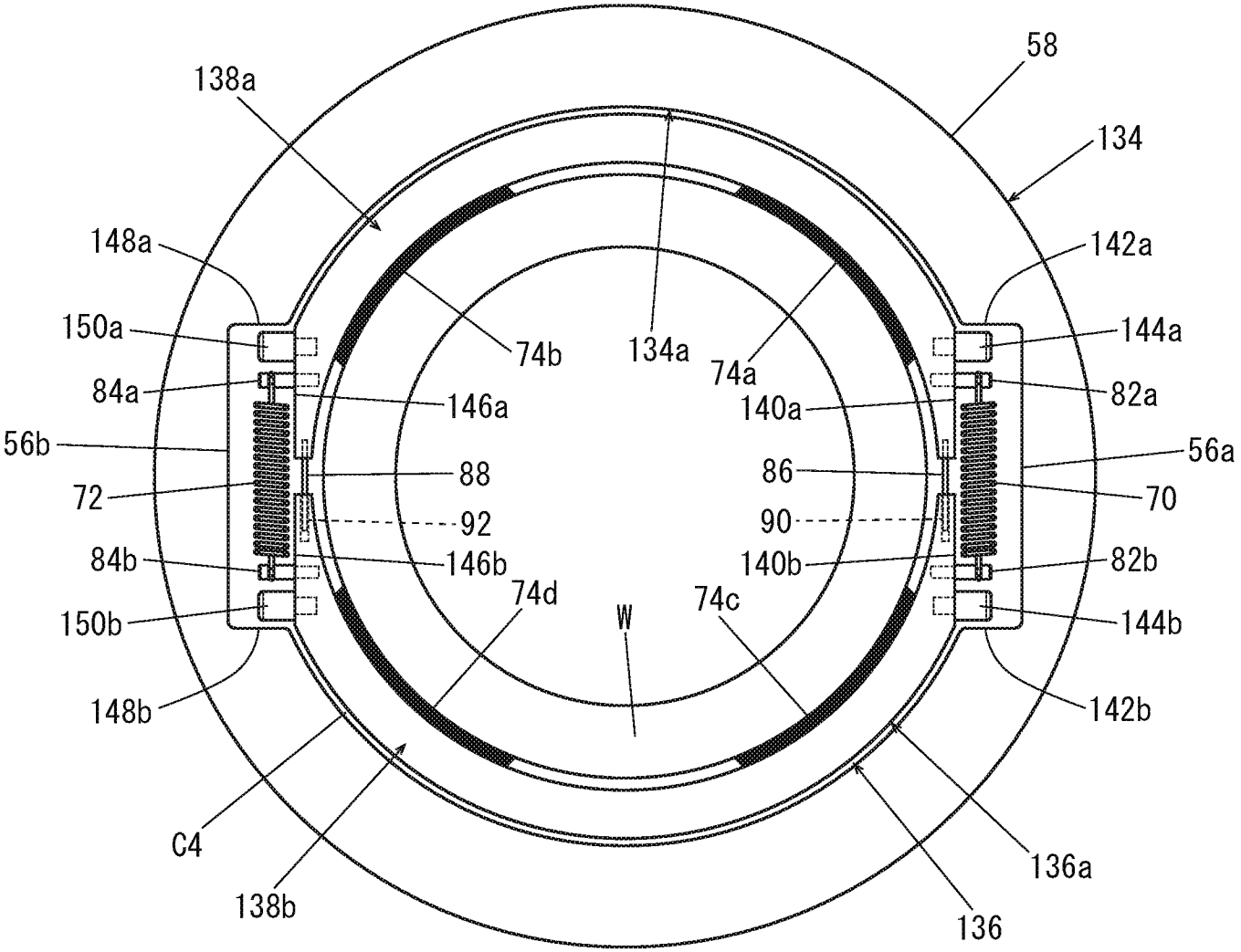
FIG. 9 is a plan view which shows still another example of the storage portion and the clamp band.

FIG. 9 is a plan view which shows a storage portion 134, a clamp band 136 and a work W.

The storage portion 134 does not have the recesses 54*a*, 54*b* but otherwise is the same as the storage portion 52, so no more description will be made here.

The clamp band 136 has a pair of clamp arms 138*a*, 138*b*. The clamp arms 138*a*, 138*b* have flat surface portions 140*a*, 140*b* at their first end portions in the circumferential direction, where pins 144*a*, 144*b* are erected to oppose to side walls 142*a*, 142*b* of the recess 56*a*. The clamp arms 138*a*, 138*b* have flat surface portions 146*a*, 146*b* at their second end portions in the circumferential direction, where pins 150*a*, 150*b* are erected to oppose to side walls 148*a*, 148*b* of the recess 56*b*. The clamp band 136 does not have the protrusions 76*a*, 76*b* but otherwise is the same as the clamp band 66, so no more description will be made here.

When the assembled work W and clamp band 136 is housed in the storage portion 134, it becomes possible to form a gap C4 between an inner circumferential portion 134*a* of the storage portion 134 and an outer circumferential portion 136*a* of the clamp band 136 around the entire circumference.

In this embodiment, the pins 144*a*, 144*b*, 150*a*, 150*b* are provided in the clamp band 136 to oppose to the side walls 142*a*, 142*b*, 148*a*, 148*b* of the storage portion 134. Therefore, when the storage portion 134 is rotated clockwise, the pin 144*a* makes engagement with the side wall 142*a*, and the pin 150*b* makes engagement with the side wall 148*b*, to function as an anti-rotation device for the clamp band 136 with respect to the storage portion 134, making it possible to rotate the clamp band 136 easily with the storage portion 134. Likewise, when the storage portion 134 is rotated counterclockwise, the pin 144*b* makes engagement with the side wall 142*b* and the pin 150*a* makes engagement with the side wall 148*a*, to function as an anti-rotation device for the clamp band 136 with respect to the storage portion 134, making it possible to rotate the clamp band 136 easily with the storage portion 134.

According to the double disc surface grinding machine which makes use of the storage portion 134 and the clamp band 136 as described, there is no need for the storage portion 134 and the clamp band 136 to be formed with recesses (like the recesses 54*a*, 54*b* in the storage portion 52) or protrusions (like the protrusions 76*a*, 76*b* in the clamp band 66), making it easy to manufacture the storage portion 134 and the clamp band 136.

Figure 10:
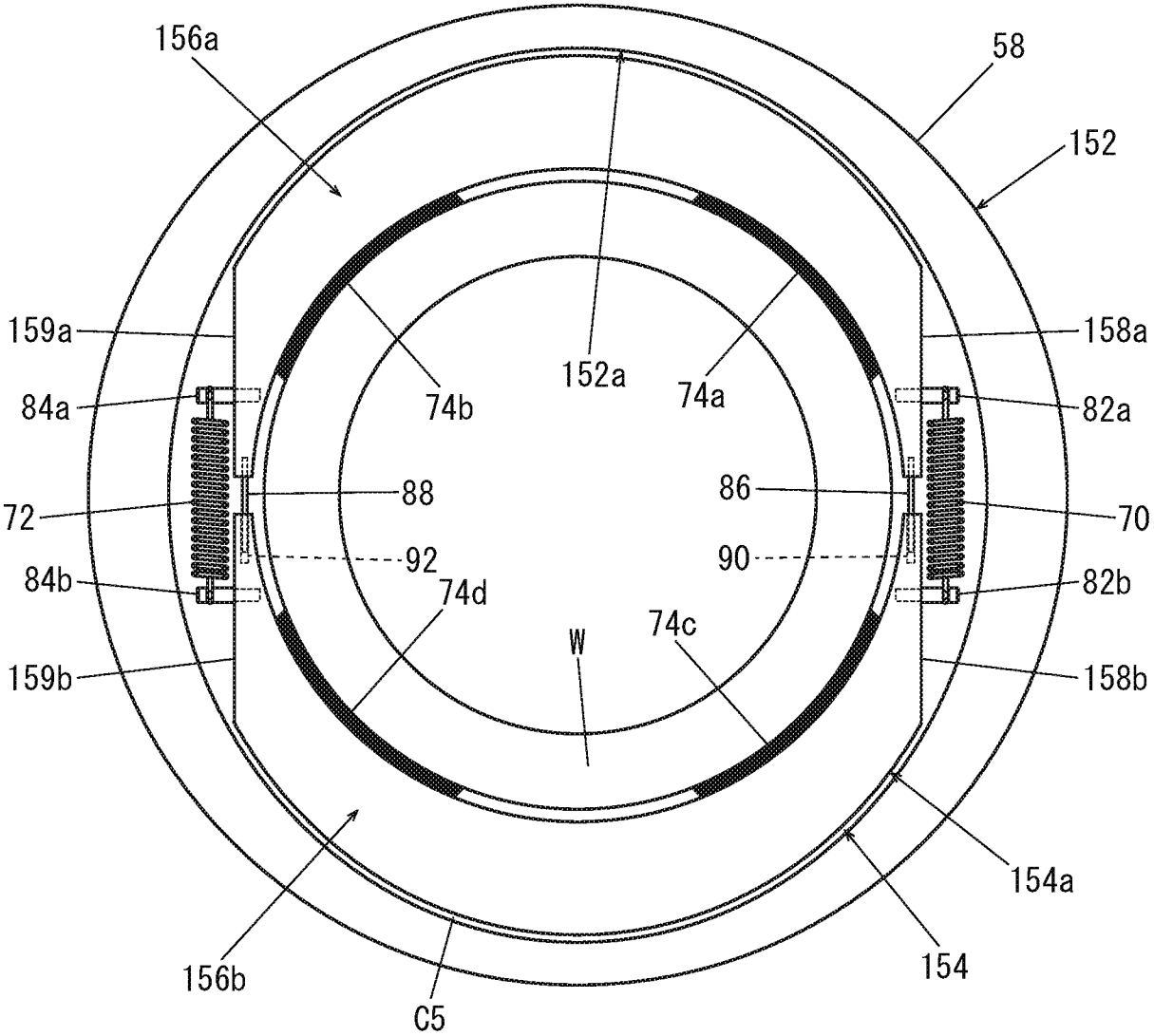
FIG. 10 is a plan view which shows another example of the storage portion and the clamp band.

FIG. 10 is a plan view which shows a storage portion 152, a clamp band 154 and a work W.

The storage portion 152 does not have the recesses 54*a*, 54*b*, 56*a*, 56*b*, and its inner circumferential portion 152*a* is elliptical in a plan view, but otherwise is the same as the storage portion 52, so no more description will be made here.

The clamp band 154 has a pair of clamp arms 156*a*, 156*b*. The clamp arms 156*a*, 156*b* have their outer circumferential portions formed like an elliptical arc in a plan view to follow the inner circumferential portion 152*a* of the storage portion 152. Also, the clamp arms 156*a*, 156*b* are radially thicker than the clamp arms 68*a*, 68*b* and accordingly, flat surface portions 158*a*, 158*b*, 159*a*, 159*b* are formed larger than the flat surface portions 78*a*, 78*b*, 80*a*, 80*b*. The clamp band 154 does not have the protrusions 76*a*, 76*b* but otherwise is the same as the clamp band 66, so no more description will be made here.

When the integrally assembled work W and clamp band 154 is housed in the storage portion 152, it becomes possible to form a gap C5 between the inner circumferential portion 152*a* of the storage portion 152 and an outer circumferential portion 154*a* of the clamp band 154 around the entire circumference.

In this embodiment, when the storage portion 152 is rotated, the outer circumferential portion 154*a* of the clamp band 154 and the inner circumferential portion 152*a* of the storage portion 152 engage with each other, to function as an anti-rotation device for the clamp band 154 with respect to the storage portion 152, making it possible to rotate the clamp band 154 easily with the storage portion 152.

According to the double disc surface grinding machine which makes use of the storage portion 152 and the clamp band 154 as described, the inner circumferential portion 152*a* of the storage portion 152 is elliptical and the outer circumferential portion 154*a* of the clamp band 154 is substantially elliptical. This makes it possible to simplify the shapes of the outer circumferential portion 154*a* of the clamp band 154 and the inner circumferential portion 152*a* of the storage portion 152, which then makes it easy to manufacture the clamp band 154 and the storage portion 152.

Figure 11:
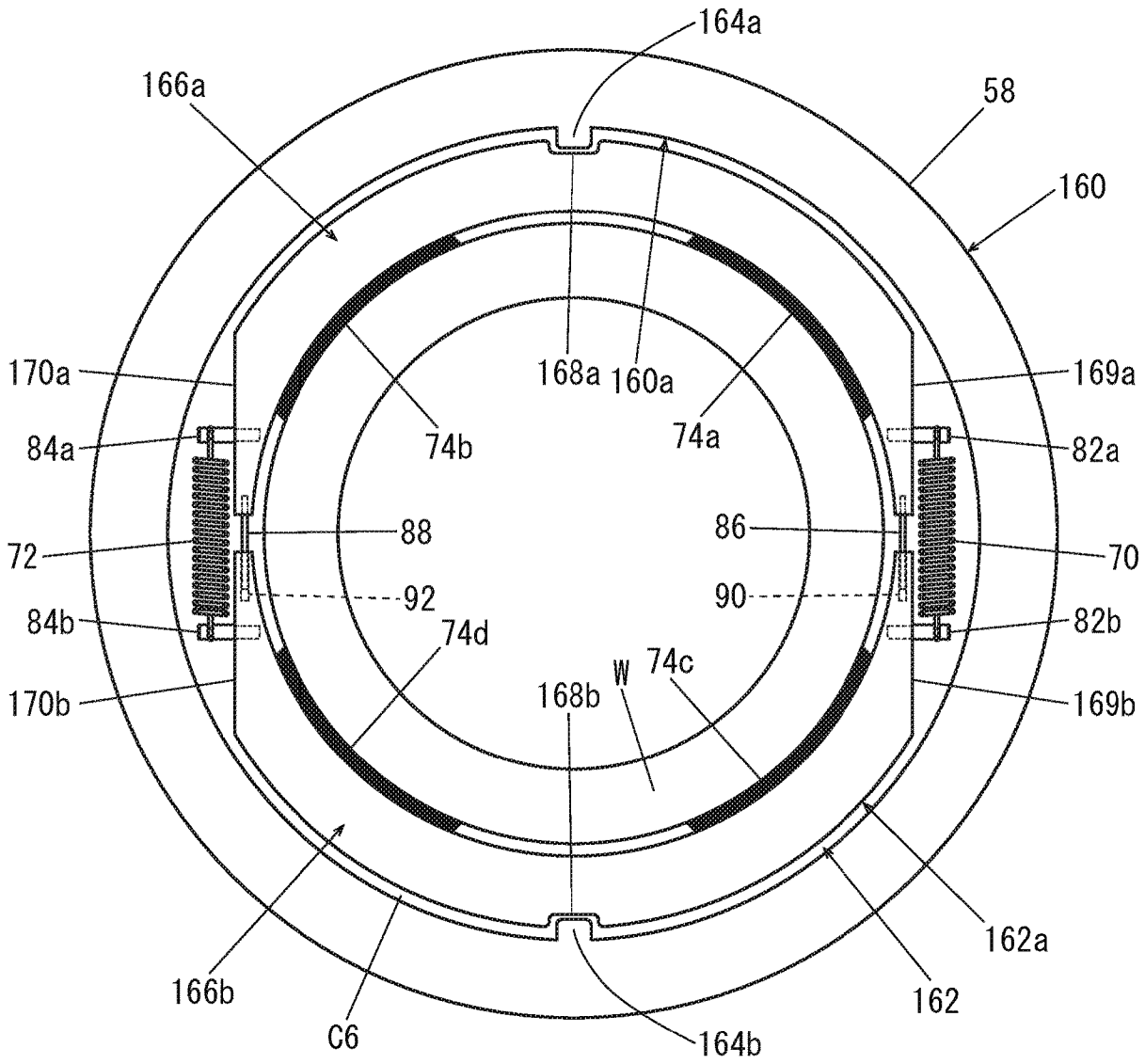
FIG. 11 is a plan view which shows another example of the storage portion and the clamp band.

FIG. 11 is a plan view which shows a storage portion 160, a clamp band 162 and a work W.

The storage portion 160 has a pair of protrusions 164*a*, 164*b* protruding radially inward in its inner circumferential portion 160*a*. Also, the storage portion 160 has a slightly thinner radial thickness in its position not formed with the protrusions 164*a*, 164*b* than part of the storage portion 52 not formed with the recesses 54*a*, 54*b*, 56*a*, 56*b*. The storage portion 160 does not have the recesses 54*a*, 54*b*, 56*a*, 56*b* but otherwise is the same as the storage portion 52, so no more description will be made here. In this embodiment, the protrusions 164*a*, 164*b* represent the second protrusion.

The clamp band 162 has a pair of clamp arms 166*a*, 166*b*. The clamp arms 166*a*, 166*b* respectively have recesses 168*a*, 168*b* recessing radially inward of the clamp band 162, in their outer circumferential portions. Also, the clamp arms 166*a*, 166*b* are radially thicker in their regions not formed with the recesses 168*a*, 168*b* than the regions of the clamp arms 68*a*, 68*b* not formed with the recesses 76*a*, 76*b* and accordingly, flat surface portions 169*a*, 169*b*, 170*a*, 170*b* are formed larger than the flat surface portions 78*a*, 78*b*, 80*a*, 80*b*. All the other arrangements of the clamp band 162 are the same as the clamp band 66, so the description will not be repeated here. In this embodiment, the recess 168*a*, 168*b* represent the second recess.

When the integrally assembled work W and clamp band 162 is housed in the storage portion 160, it becomes possible to form a gap C6 between the inner circumferential portion 160*a* of the storage portion 160 and an outer circumferential portion 162*a* of the clamp band 162 around the entire circumference.

In this embodiment, when the protrusions 164*a*, 164*b* are positioned at the recesses 168*a*, 168*b* and then the storage portion 160 is rotated, the protrusion 164*a* makes engagement with the recess 168*a*, and the protrusions 164*b* makes engagement with the recess 168*b*, functioning as an anti-rotation device for the clamp band 162 with respect to the storage portion 160, making it possible to rotate the clamp band 162 easily with the storage portion 160.

According to the double disc surface grinding machine which makes use of the storage portion 160 and the clamp band 162 as described, it is possible to form the inner circumferential portion 160*a* of the storage portion 160, other than those regions formed with the protrusions 164*a*, 164*b*, into an arc-like shape without forming recesses or protrusions. This makes it easy to manufacture the storage portion 160.

Figure 12A:
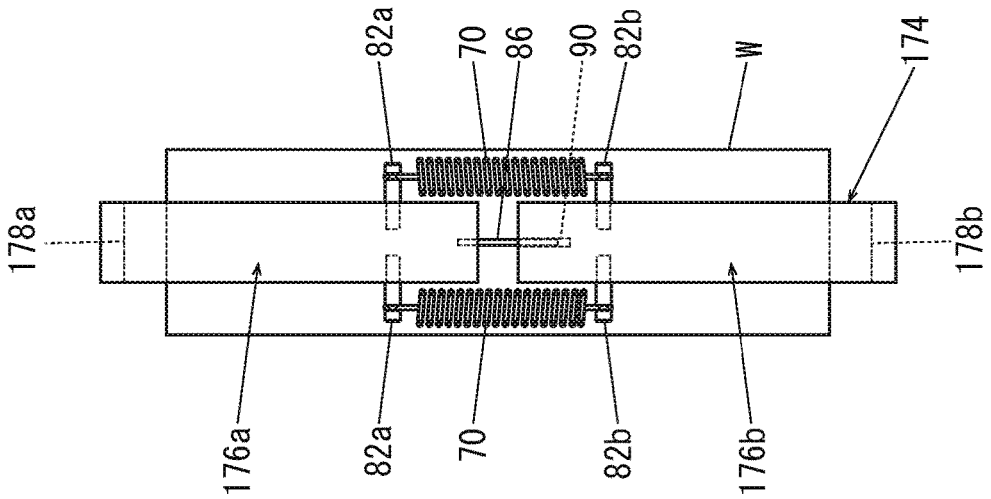
FIG. 12A and FIG. 12B show still another example of the storage portion and the clamp band.
Figure 12B:
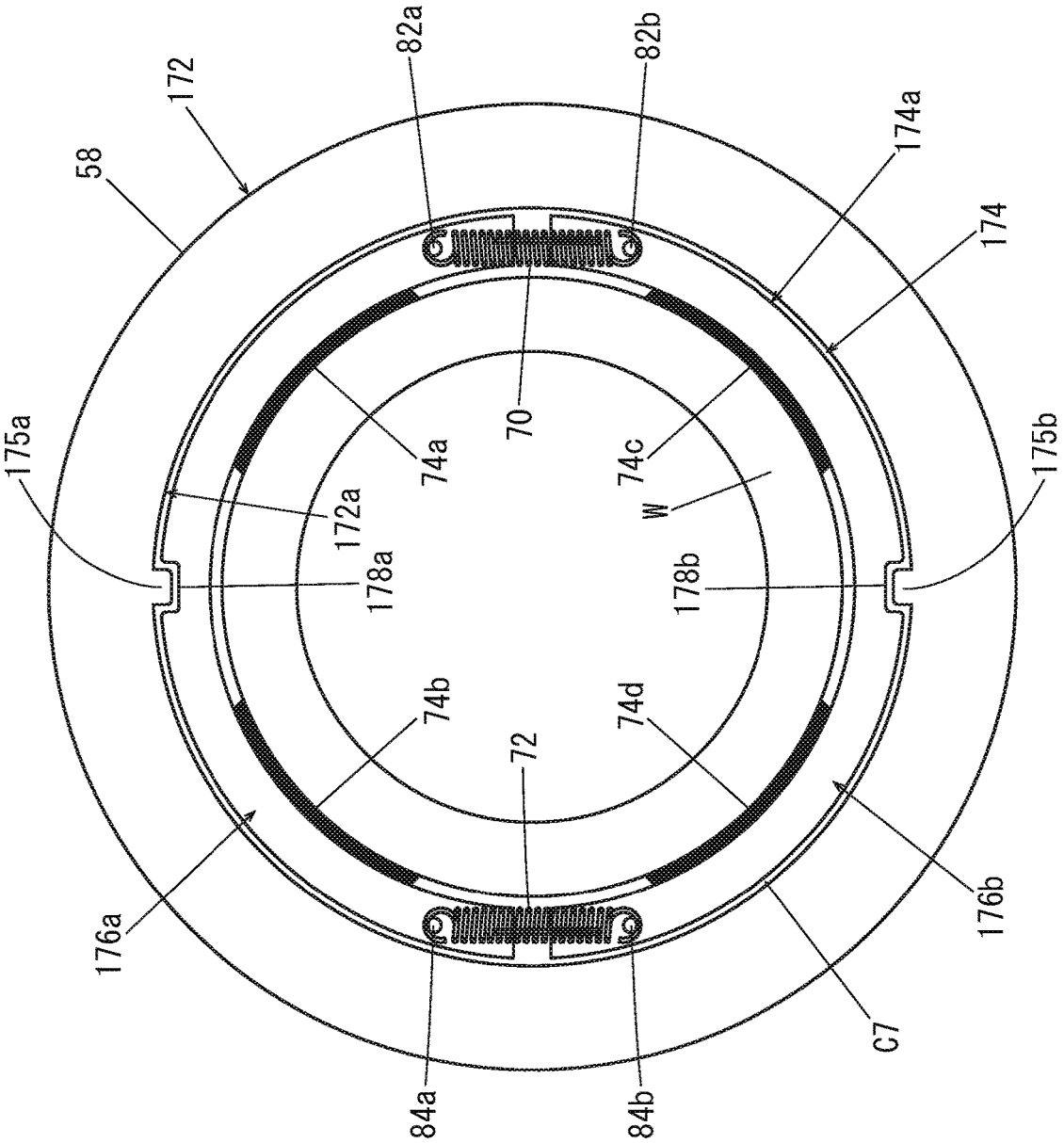

FIG. 12A and FIG. 12B show a storage portion 172, a clamp band 174 and a work W: FIG. 12A is a side view and FIG. 12B is a plan view. For a purpose of avoiding too much complication in the drawing, FIG. 12A does not show the storage portion 172.

The storage portion 172 has a pair of protrusions 175*a*, 175*b* protruding radially inward in its inner circumferential portion 172*a*. The storage portion 172 does not have the recesses 54*a*, 54*b*, 56*a*, 56*b* but otherwise is the same as the storage portion 52, so no more description will be made here. In this embodiment, the protrusions 175*a*, 175*b* represent the second protrusion.

The clamp band 174 has a pair of clamp arms 176*a*, 176*b*. The clamp arms 176*a*, 176*b* respectively have recesses 178*a*, 178*b* recessing radially inward of the clamp band 174, in their outer circumferential portions. The clamp arms 176*a*, 176*b* are connected to each other at their first opposed end portions in the circumferential direction when first elastic members 70 are hooked correspondingly onto posts 82*a*, 82*b* which are formed in upper surfaces and posts 82*a*, 82*b* which are formed in lower surfaces. The clamp arms 176*a*, 176*b* are connected to each other at their second opposed end portions in the circumferential direction when second elastic members 72 are hooked correspondingly onto posts 84*a*, 84*b* which are formed in the upper surfaces and posts 84*a*, 84*b* (not illustrated) which are formed in lower surfaces. The clamp band 174 does not have the protrusions 76*a*, 76*b*, nor the flat surface portions 78*a*, 78*b*, 80*a*, 80*b*, but otherwise is the same as the clamp band 66, so no more description will be made here. In this embodiment, the recesses 178*a*, 178*b* represent the second recess.

When the integrally assembled work W and clamp band 174 is housed in the storage portion 172, it becomes possible to form a gap C7 between the inner circumferential portion 172*a* of the storage portion 172 and the outer circumferential portion 174*a* of the clamp band 174 around the entire circumference.

In this embodiment, when the protrusions 175*a*, 175*b* are positioned at the recesses 178*a*, 178*b* and then the storage portion 172 is rotated, the protrusions 175*a*, 175*b* make engagement with the recesses 178*a*, 178*b*, functioning as an anti-rotation device for the clamp band 174 with respect to the storage portion 172, making it possible to rotate the clamp band 174 easily with the storage portion 172.

According to the double disc surface grinding machine which makes use of the storage portion 172 and the clamp band 174 as described, there is no need for providing the outer circumferential portion 174*a* of the clamp band 174 with portions protruding radially outward of the clamp band 174. This makes it possible to reduce the radial thickness of the clamp band 174. Since this makes it possible to reduce the weight of the clamp band 174, it becomes even easier to move the work W and the clamp band 174 in Arrow V direction, and it is possible to further improve machining accuracy of the two main surfaces of the work W.

Since there is no need to form the flat surface portions 78*a*, 78*b*, 80*a*, 80*b* in the clamp band 174, it is easy to manufacture the clamp band 174.

Providing the posts 82*a*, 82*b*, 84*a*, 84*b*, the first elastic member 70 and the second elastic member 72 in the upper surfaces and the lower surfaces of the clamp arms 176*a*, 176*b* eliminates the need for forming the recesses (like the recesses 56*a*, 56*b* in the storage portion 52) in the storage portion 172. This makes it easy to manufacture the storage portion 172.

Four elastic members (two first elastic members 70 and two second elastic members 72) clamp the work W, and therefore it is possible to reliably fix the clamp band 174 to the outer circumferential surface of the work W. This makes it possible to rotate the work W reliably, and to improve machining accuracy of the work W.

The arrangement allows to decrease the radial thickness of the clamp band 174 around the entire circumference, and gives some room for increasing the diameter of the inner circumferential portion 172*a* of the storage portion 172. It is easy, therefore, to accept a work which has a large outer diameter, by increasing the diameter of the inner circumferential portion 172*a* of the storage portion 172 and the size of the clamp band 174.

Figure 13A:
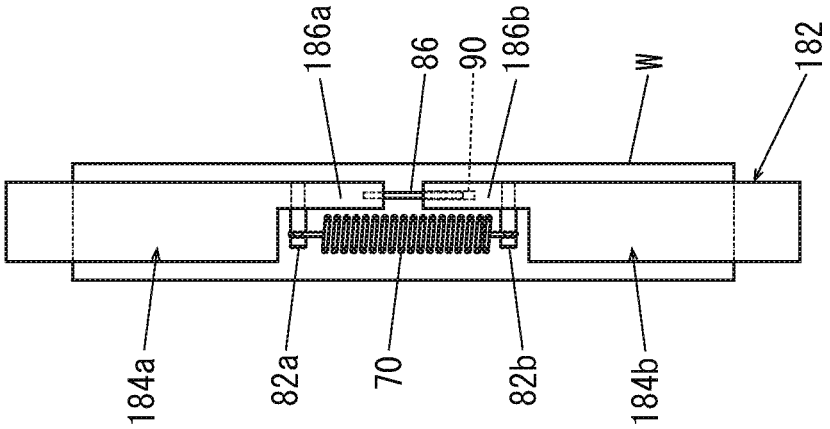
FIG. 13A and FIG. 13B show another example of the storage portion and the clamp band.
Figure 13B:
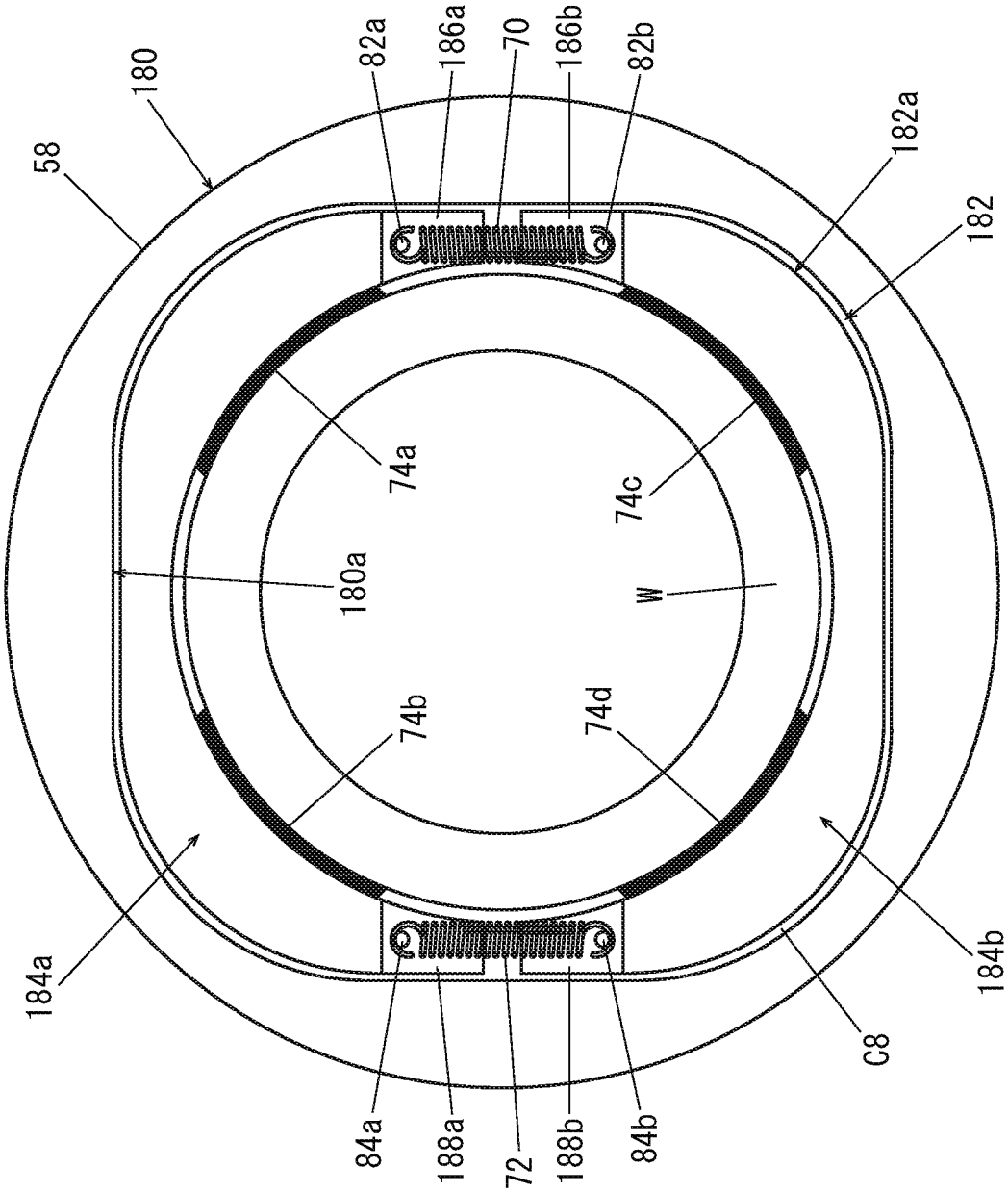

It should be noted here that even those works which have a relatively large outer diameter and are thin-walled can be handled easily if a thin-wall portions are formed at two end portions of the clamp arms 176*a*, 176*b* and connection is made as shown in FIG. 13A and FIG. 13B as will be described later.

There also may be an arrangement that the posts 82*a*, 82*b*, 84*a*, 84*b*, the first elastic member 70 and the second elastic member 72 are provided only in the upper surfaces of the clamp arms 176*a*, 176*b*.

FIG. 13A and FIG. 13B show a storage portion 180, a clamp band 182 and a work W: FIG. 13A is a side view and FIG. 13B is a plan view. For a purpose of avoiding too much complication in the drawing, FIG. 13A does not show the storage portion 180.

The storage portion 180 does not have the recesses 54*a*, 54*b*, 56*a*, 56*b* and its inner circumferential portion 180*a* is substantially rectangular in a plan view, but otherwise is the same as the storage portion 52, so no more description will be made here.

The clamp band 182 has a pair of clamp arms 184*a*, 184*b*, and an outer circumferential portion 182*a* formed as substantially rectangular in a plan view. The clamp arms 184*a*, 184*b* have their outer circumferential portions formed like a shape of substantially U in a plan view to follow the inner circumferential portion 180*a* of the storage portion 180. The clamp arms 184*a*, 184*b* have thin-wall portions 186*a*, 186*b* at their mutually adjacent first end portions in the circumferential direction. Posts 82*a*, 82*b* are erected on upper surfaces of the thin-wall portions 186*a*, 186*b*, i.e., surfaces perpendicular to an axis of the clamp band 182. None of the posts 82*a*, 82*b* and a first elastic member 70 which is hooked onto the posts 82*a*, 82*b* protrude beyond the clamp arms 184*a*, 184*b*. The clamp arms 184*a*, 184*b* have mutually adjacent thin-wall portions 188*a*, 188*b* at their second end portions in the circumferential direction. Posts 84*a*, 84*b* are erected on upper surfaces of the thin-wall portions 188*a*, 188*b*, i.e., surfaces perpendicular to the axis of the clamp band 182. None of the posts 84*a*, 84*b* and a second elastic member 72 which is hooked onto the posts 84*a*, 84*b* protrude beyond the clamp arms 184*a*, 184*b*. The clamp band 182 does not have the protrusions 76*a*, 76*b*, nor the flat surface portions 78*a*, 78*b*, 80*a*, 80*b*, but otherwise is the same as the clamp band 66, so no more description will be made here.

When the integrally assembled work W and clamp band 182 is housed in the storage portion 180, it becomes possible to form a gap C8 between the inner circumferential portion 180*a* of the storage portion 180 and the outer circumferential portion 182*a* of the clamp band 182 around the entire circumference.

In this embodiment, when the storage portion 180 is rotated, the outer circumferential portion 182*a* of the clamp band 182 and the inner circumferential portion 180*a* of the storage portion 180 engage with each other, to function as an anti-rotation device for the clamp band 182 with respect to the storage portion 180, making it possible to rotate the clamp band 182 easily with the storage portion 180.

According to the double disc surface grinding machine which makes use of the storage portion 180 and the clamp band 182 as described, the inner circumferential portion 180*a* of the storage portion 180 is substantially rectangular and the outer circumferential portion 182*a* of the clamp band 182 is substantially rectangular. This makes it possible to make four engagement points between the clamp band 182 and the storage portion 180 when the storage portion 180 is rotated. The arrangement makes it possible to rotate the work W smoothly. This makes it possible to further improve machining accuracy of the work W.

Providing the posts 82*a*, 82*b*, 84*a*, 84*b*, the first elastic member 70 and the second elastic member 72 in the upper surfaces of the thin-wall portions 186*a*, 186*b*, 188*a*, 188*b* eliminates the need for forming the recesses (like the recesses 56*a*, 56*b* in the storage portion 52) in the storage portion 180. This makes it easy to manufacture the storage portion 180.

Since none of the posts 82*a*, 82*b*, 84*a*, 84*b*, the first elastic member 70 and the second elastic member 72 protrude beyond the clamp arms 184*a*, 184*b*, the arrangement makes it possible to reduce increase in the axial dimension of the clamp band 182, and therefore to grind even thin-wall works.

It should be noted here that the clamp arms 184*a*, 184*b* may be connected to each other without making the thin-wall portions 186*a*, 186*b*, 188*a*, 188*b*.

Also, the posts 82*a*, 82*b*, 84*a*, 84*b*, the first elastic member 70 and the second elastic member 72 may be provided not only in the upper surfaces of the clamp arms 184*a*, 184*b* but also in the lower surfaces thereof.

In the embodiment described above, description was made for a case where the inner circumferential portion of the storage portion and the outer circumferential portion of the clamp band are formed to be along with each other. However, the present invention is not limited to this. It is not necessary that the inner circumferential portion of the storage portion and the outer circumferential portion of the clamp band are made to be along with each other, as far as the inner circumferential portion of the storage portion and the outer circumferential portion of the clamp band engage with each other to transmit rotation of the storage portion to the clamp band and the clamp band is movable in Arrow V direction.

In the embodiment described above, description was made for a case where when the assembled work W and clamp band is housed in the storage portion, it becomes possible to form a gap between the inner circumferential portion of the storage portion and the outer circumferential portion of the clamp band around the entire circumference. However, the present invention is not limited to this. The gap need not necessarily exist between the inner circumferential portion of the storage portion and the outer circumferential portion of the clamp band as far as the clamp band can move in Arrow V direction.

In the embodiment described above, description was made for a case where a pair of protrusions and a pair of recesses are formed. However, the present invention is not limited to this. There may be formed one protrusion and one recess.

In the embodiment described above, description was made for a case where four contact members 74*a* through 74*d* are formed each in a strip-like shape. However, the present invention is not limited to this. For example, there may be an arrangement where the contact member 74*a* is connected to the contact member 74*b* and the contact member 74*c* is connected to the contact member 74*d*. As another example, the contact member (s) may be provided so as to make contact with the entire circumference of the outer circumferential surface of the work W, or may be provided like substantially dots.

In the embodiment described above, description was made for a case where the contact members 74*a* through 74*d* are made of rubber. However, the present invention is not limited to this. For example, the contact members may be made of a brake-lining material or a carbon fiber or the like. Also, the contact members may be fixed with screws or the like.

In the embodiment described above, description was made for a case where the clamp arms are made of an aluminum alloy. However, the present invention is not limited to this. For example, the clamp arms may be made of a fiber-reinforced plastic, a carbon fiber or a ferrous steel. In cases where the clamp arms are made of a fiber-reinforced plastic or a carbon fiber, it is possible to reduce the weight of the clamp band, which makes it easier to move the work W and the clamp band in Arrow V direction, and to further improve machining accuracy of the two main surfaces of the work W. Also, since it is possible to increase strength of the clamp arms, it is possible to reduce likelihood of damage to the clamp band even in cases where a large torque is required to rotate the work W. The clamp arms are corrosion resistant if it is made of a fiber-reinforced plastic, or superior in wear resistance if it is made of a carbon fiber. In both of the cases, it is possible to use the clamp band for a long period. In cases where the clamp arms are made of a ferrous steel, it is possible to increase strength of the clamp arms. This makes it possible to reduce likelihood of damage to the clamp band even in cases where a large torque is required to rotate the work W. Also, in cases where the clamp arms are made of a ferrous steel, the clamp band can be made at a low cost.

In the embodiment described above, the grinding wheel 14*b* is held at a fixed position while the work W is being ground. However, there may be an arrangement that the work W is ground while the grinding wheel feeder 24*b* lifts the grinding wheel 14*b*. In this case, the grinding wheel feeders 24*a*, 24*b* represent the grinding wheel feeding section. Also, there may be an arrangement where the position of the grinding wheel 14*a* is fixed and only the grinding wheel 14*b* is lifted to grind the work W. In this case, the grinding wheel feeder 24*b* represents the grinding wheel feeding section. The grinding wheel 14*b* need not necessarily have the same cutting speed as the grinding wheel 14*a*.

In the embodiment described above, description was made for a case where the rotation plate is capable of supporting one storage portion. However, the present invention is not limited to this. A rotation plate capable of supporting two or more storage portions may be used.

In the embodiment described above, description was made for a case where the present invention is applied to an upright double disc surface grinding machine. However, the present invention is also applicable to a horizontal double disc surface grinding machine.

In the embodiment described above, description was made for a case where a circular annular work W is ground. However, the shape of works grindable by the double disc surface grinding machine according to the present invention is not limited to those in the embodiments described above. The double disc surface grinding machine according to the present invention is capable of grinding various works (e.g., disc-like, cylindrical, elliptical and platy or polygonal and platy, works). Also, the double disc surface grinding machine according to the present invention is capable of grinding those works which has a recess(es) or a cutout(s) on its outer circumferential surface. When grinding a work having a small diameter, the radial thickness of the clamp band should simply be increased.

The present invention being thus far described in terms of preferred embodiments, it is obvious that these may be varied in many ways within the scope and the spirit of the present invention. The scope of the present invention is only limited by the accompanied claims.

The invention claimed is:

1. A double disc work grinding machine comprising:

a pair of work grinding wheels within the grinding machine, the pair of work grinding wheels being opposed to each other and being separated at a distance therebetween in a first direction, to grind two main surfaces of a work;

a clamp member having a non-circular outer circumferential portion and clamping an outer arcuate circumferential surface of the work to thereby fix the clamp member to the work to assemble the work and the clamp member integrally with each other;

a storage portion having a non-circular inner circumferential portion engageable with the non-circular outer circumferential portion of the clamp member, wherein the storage portion houses the clamp member movably in the first direction between the pair of work grinding wheels and rotates together with the clamp member, and the clamp member clamping the work;

a rotation drive section which rotates the storage portion around a first rotation axis of the storage portion extending in the first direction; and a grinding wheel feeding section which feeds at least one of the work grinding wheels onto the work for sandwiching the work with the pair of work grinding wheels and grinding two main surfaces of the work, wherein the first rotation axis of the storage portion extends inside the outer circumferential surface of the work when viewed from the first direction, under a state where the clamp member clamping the work is housed in the storage portion, upon clamping, the diameter of an inner circumferential portion of the clamp member is substantially the same as the outer circumferential surface of the work, and the clamp member and the storage portion each has a thickness in the first direction less than the work for allowing insertion of the work, the storage portion, and the clamp member between the pair of the work grinding wheels when grinding the work.

2. The double disc work grinding machine according to claim 1, wherein a gap is formable between the outer circumferential portion of the clamp member and the inner circumferential portion of the storage portion around the entire circumference under a state where the clamp member, which clamps the work, is housed in the storage portion.

3. The double disc work grinding machine according to claim 1, wherein the inner circumferential portion of the storage portion is elliptical, and the outer circumferential portion of the clamp member is substantially elliptical.

4. The double disc work grinding machine according to claim 1, wherein the inner circumferential portion of the storage portion is substantially rectangular, and the outer circumferential portion of the clamp member is substantially rectangular.

5. The double disc work grinding machine according to claim 1, wherein the clamp member is annular and has a first protrusion protruding radially outward of the clamp member in the outer circumferential portion, and the storage portion has a first recess engageable with the first protrusion in the inner circumferential portion.

6. The double disc work grinding machine according to claim 1, wherein the clamp member is annular and has a first recess recessing radially inward of the clamp member in the outer circumferential portion, and the storage portion has a first protrusion engageable with the first recess in the inner circumferential portion.

7. The double disc work grinding machine according to claim 1, wherein the clamp member has a pair of clamp arms, a first elastic member which connects first end portions of the clamp arms with each other, and a second elastic member which connects second end portions of the clamp arms with each other, and the clamp member clamps the outer circumferential surface of the work with a clamping action to the work provided by the pair of clamp arms pulled toward each other by the first elastic member and the second elastic member.

8. The double disc work grinding machine according to claim 1, wherein the clamp member has a pair of clamp arms having respective first end portions thereof connected to each other for mutually opening and closing operation, and an elastic member which connects respective second end portions of the clamp arms to each other, and the clamp member clamps the outer circumferential surface of the work with a clamping action to the work provided by the pair of clamp arms pulled toward each other by the elastic member.

9. The double disc work grinding machine according to claim 1, wherein the clamp member has a contact member for making contact to the outer circumferential surface of the work, and the contact member has a coefficient of friction greater than those of other parts of the clamp member.

10. The double disc work grinding machine according to claim 7, wherein the clamp arms are made of an aluminum alloy.

11. The double disc work grinding machine according to claim 7, wherein the clamp arms are made of a fiber-reinforced plastic.

12. The double disc work grinding machine according to claim 7, wherein the clamp arms are made of a carbon fiber.

13. The double disc work grinding machine according to claim 7, wherein the clamp arms are made of a ferrous steel.

14. A grinding method for grinding a work with a pair of rotating work grinding wheels opposed to each other at a distance therebetween in a first direction, the grinding method, comprising:

a clamping step of clamping an outer arcuate circumferential surface of the work by a clamp member to assemble the work and the clamp member integrally with each other, the clamp member having a non-circular outer circumferential portion, a housing step of housing the clamp member movably in the first direction between the pair of work grinding wheels, the clamp member clamping the work, into a storage portion, the storage portion having a non-circular inner circumferential portion engageable with the outer circumferential portion of the clamp member and being rotatable together with the clamp member;

a rotation step of rotating the clamp member and the work with the storage portion by rotating the storage portion around a first rotation axis of the storage portion extending in the first direction and engaging the inner circumferential portion of the storage portion with the outer circumferential portion of the clamp member; and a feeding step of feeding at least one of the work grinding wheels onto the work so as to sandwich the work with the pair of work grinding wheels for grinding two main surfaces of the work, wherein the first rotation axis of the storage portion extends inside the outer circumferential surface of the work when viewed from the first direction, under a state where the clamp member clamping the work is housed in the storage portion, upon clamping, the diameter of an inner circumferential portion of the clamp member is substantially the same as the outer circumferential surface of the work, and the clamp member and the storage portion each has a thickness in the first direction less than the work for allowing insertion of the work, the storage portion, and the clamp member between the pair of the work grinding wheels when grinding the work.

* * * * *